US005660066A

United States Patent [19]

Asano et al.

[11] Patent Number: 5,660,066

[45] Date of Patent: Aug. 26, 1997

[54] INTERSTAND TENSION CONTROLLER FOR A CONTINUOUS ROLLING MILL

[75] Inventors: Kazuya Asano; Kazuhiro Yamamoto, both of Chiba, Japan

[73] Assignee: Kawasaki Steel Corporation, Kobe, Japan

[21] Appl. No.: 318,105

[22] Filed: Oct. 5, 1994

[51] Int. Cl.[6] ..... B21B 37/00

[52] U.S. Cl. ..... 72/11.4; 72/12.3; 72/205; 72/365.2; 72/8.6

[58] Field of Search ..... 72/8–11, 17, 234, 72/365.2, 366.2, 8.6, 11.4, 12.3, 205; 364/472

[56] References Cited

U.S. PATENT DOCUMENTS

| | | | |
|---|---|---|---|
| 4,379,395 | 4/1983 | Konishi et al. | 72/8.6 |
| 4,507,946 | 4/1985 | Koyama et al. | 72/8.6 |
| 5,040,395 | 8/1991 | Seki et al. | 72/17 |
| 5,043,863 | 8/1991 | Bristol et al. | 364/165 |
| 5,103,662 | 4/1992 | Fapiano | 72/8.6 |
| 5,233,852 | 8/1993 | Starke | 72/7.6 |
| 5,325,692 | 7/1994 | Hoshino et al. | 72/8.6 |
| 5,404,738 | 4/1995 | Sekiguchi | 72/17 |

FOREIGN PATENT DOCUMENTS

| | | |
|---|---|---|
| A-0 005 450 | 11/1979 | European Pat. Off. . |
| A-0 162 361 | 11/1985 | European Pat. Off. . |
| A-26 18 901 | 11/1976 | Germany . |
| A-28 21 396 | 11/1979 | Germany . |
| A-33 14 466 | 11/1983 | Germany . |
| A-40 03 548 | 9/1990 | Germany . |
| A-59 110 410 | 6/1984 | Japan . |
| 59-110410 | 6/1984 | Japan . |
| A-59 118 213 | 7/1984 | Japan . |
| A-59 118 214 | 7/1984 | Japan . |
| 59-118213 | 7/1984 | Japan . |
| 59-118214 | 7/1984 | Japan . |

*Primary Examiner*—Lowell A. Larson
*Assistant Examiner*—Ed Tolan
*Attorney, Agent, or Firm*—Oliff & Berridge

[57] ABSTRACT

An interstand tension controller for a continuous rolling mill having a plurality of rolling stands and provided with a looper between the adjacent rolling stands controls two controlled variables, i.e., the interstand tension of the workpiece and the looping angle of the looper, to adjust the measured interstand tension and the measured looping angle to desired values, has control loops that control the rotating speed of the rolls of the rolling stand and the looping torque or the looping speed of the looper to regulate the interstand tension and the looping angle, estimates disturbances acting on the control loops, the variation of the characteristics of the controlled system and the interference between the control loops, and operates manipulated variables to offset the disturbances.

21 Claims, 33 Drawing Sheets

C : Cross controller
SR : Rolling Speed Regulator
TR : Looping Torque Regulator

FIG.11

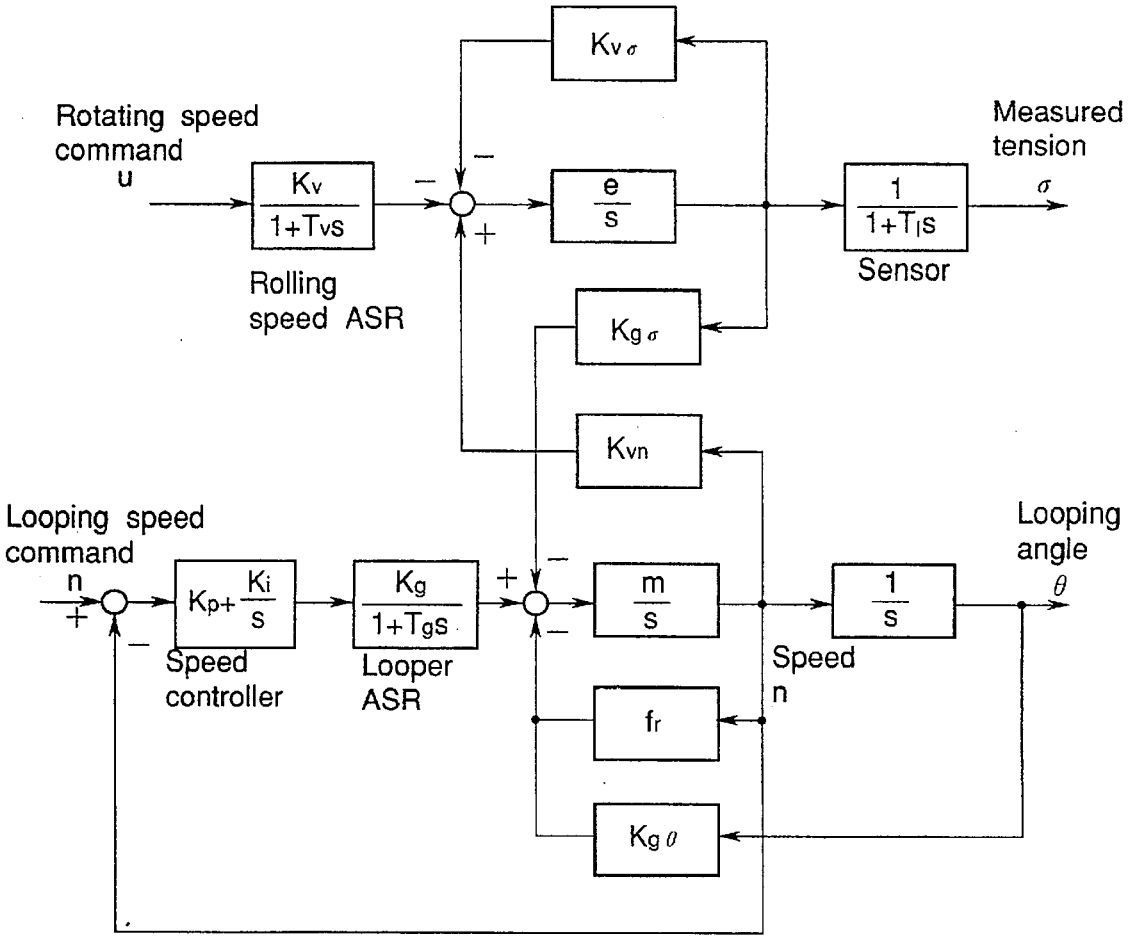

$K_{v\sigma}$: Tension - to - speed influence coefficient
$e=E \cdot A / l$ E : Young's modulus
A : Sectional area of strip
l : Geometrical length of strip
$K_{vn}$ : Looping - angle - to - strip - length influence coefficient
$K_{g\sigma}$: Tension - to - looper - load - torque influence coefficient
$M=1 / J$ J : Looper moment of inertia
$K_{g\theta}$: Angle - to - torque influence coefficient
$f_r$ : Looper friction coefficient

INTERSTAND TENSION CONTROLLER FOR A CONTINUOUS ROLLING MILL

BACKGROUND OF THE INVENTION

1. Field of the Invention

The present invention relates to an interstand tension controller for controlling the interstand tension of a workpiece being rolled on a continuous rolling mill having a plurality of rolling stands and provided with a looper between the adjacent rolling stands and, more specifically, to an interstand tension controller suitable for application to a hot finishing mill, and capable of satisfactorily carrying out interstand tension control operation without being disturbed by interaction between the tension of the workpiece and the looping angle, having a simple configuration and capable of being easily adjusted.

2. Description of the Related Art

A hot finishing mill has rolling stands and is provided with a looper disposed between the adjacent rolling stands to stabilize the interstand tension of the workpiece. It is important for carrying out stable rolling operation to stabilize the tension of the workpiece that affects directly the size and the shape of the workpiece by the looper and to suppress the variation of looping angle. Two manipulated variables, i.e., the rotating speed of the rolls of the rolling stand and the looping torque, are controlled to regulate the tension of the workpiece and the looping angle. As shown in FIG. 1, a most common interstand tension controller controls looping angle $\theta$ by regulating the rotating speed of the rolls of an upper rolling stand i or that of the rolls of a lower rolling stand i+1 and regulates the looping torque according to the variation of the looping angle $\theta$ to adjust the tension $\sigma$ to a desired value. The tension control performance of this interstand tension controller, however, is not satisfactory because the tension is controlled in an open-loop control mode. Tension and looping angle interact with each other, namely, the variation of tension entails the variation of looping angle, and vice versa. Being unable to deal with interaction between the tension and the looping angle, the conventional interstand tension controller is unable to stabilize the looping angle.

A controller disclosed in Japanese Patent Laid-open No. 59-110410 measures the tension of the workpiece with a load cell or the like installed in a looper, regulates the rotating speed of the rolls of the rolling stand, i.e., a manipulated variable, to regulate the tension by a feedback loop, and regulates the looping torque or the looping speed, i.e., a manipulated variable, to regulate the looping angle by another feedback loop.

Another controller places a precompensator C, which generally is called a cross controller, before a looper characteristic block G that indicates looper characteristics as shown in FIG. 2 to offset the interaction between the tension and the looping angle by the synergetic effect of the precompensator C and the looper characteristic block G.

Integrating optimum regulators disclosed in Japanese Patent Laid-open Nos. 59-118213 and 59-118214 control the operating speed of a looper driving motor, and use, in combination, a feedback operation for feeding back measurable values, i.e., tension, looping angle and operating speed of the looper driving motor, and a main controller that carries out integration to optimize a P-gain index of performance and an I-gain index of performance in a time domain. To obtain a desired control response by this integrating optimum regulator, an optimum control gain must be determined by setting a weighting matrix for a quadratic evaluation function by a trial-and-error method. A previously proposed H-infinity controller is an improvement of the integrating optimum regulator and specifies closed-loop response in a frequency domain to facilitate the design.

However, since the noninteractive interstand tension controller sets an inverse model of a controlled system in the cross controller, the noninteractive interstand tension controller is unable to deal with variations in the characteristics of the controlled system satisfactorily and is incapable of offsetting the effect of a disturbance, such as the variation of the rolling speed.

The integrating optimum regulator and the H-infinity control are difficult to adjust at the site because the integrating optimum regulator and the H-infinity control need a controller having a complicated configuration, an evaluation function must be determined and the parameters of the controller must be designed so as to optimize the evaluation function.

SUMMARY OF THE INVENTION

The present invention has been made in view of the foregoing problems in the conventional controller and it is therefore a first object of the present invention to provide an interstand tension controller to be used in combination with a continuous rolling mill having a plurality of rolling stands and provided with a looper between the adjacent rolling stands, for controlling the interstand tension of a workpiece being rolled on the continuous rolling mill and for controlling the looper, capable of satisfactorily controlling the interstand tension of the workpiece and the looper without being influenced by interaction between the interstand tension and the looping angle, and having a simple configuration capable of being easily adjusted.

A second object of the present invention is to provide an interstand tension controller for a continuous rolling mill having a plurality of rolling stands and provided with a looper between the adjacent rolling stands, for controlling the interstand tension of a workpiece being rolled on the continuous rolling mill and for controlling the looper, capable of enhancing the stability of the interstand tension and the looping angle without completely nullifying the effect of interactions between the interstand tension and the looping angle.

A third object of the present invention is to provide a control system for controlling the interstand tension of a workpiece being rolled on a continuous rolling mill, and the looper of the continuous rolling mill, resistant to disturbances and the variation of the characteristics of the controlled object in integrating optimum regulation and H-infinity control where many feedback loops are used.

In a first aspect of the present invention, an interstand tension controller for a continuous rolling mill having a plurality of rolling stands and provided with a looper between the adjacent rolling stands comprises:

a first feedback loop that measures or estimates the interstand tension of the workpiece, calculates a rotating speed command specifying a desired rotating speed for the rolls of the rolling stand on the basis of the difference between a desired interstand tension, and a measured or estimated working interstand tension, and corrects the rotating speed command;

a second feedback loop that measures the looping angle, calculates a looping torque command specifying a desired looping torque or a looping speed command specifying a desired looping speed on the basis of the difference between the measured looping angle and a desired looping angle;

a first disturbance compensator that estimates a disturbance acting on the first feedback loop on the basis of the difference between an estimated tension obtained by applying a sum of the rotating speed command calculated by the first feedback loop and a rotating speed correction calculated by the first disturbance compensator to a model that receives the rotating speed command specifying a rotating speed for the rolls of the rolling stand and provides an interstand tension, and the measured or estimated working tension, and calculates the rotating speed correction for the rolls to offset the estimated disturbance; and a second disturbance compensator that estimates a disturbance acting on the second feedback loop on the basis of the difference between an estimated looping angle obtained by applying a sum of the looping torque command or the looping speed command calculated by the second feedback loop and a looping torque correction or a looping speed correction calculated by the second disturbance compensator to a model that receives the looping torque command or the looping speed command and provides a looping angle, and a measured looping angle, and calculates the looping torque correction or the looping speed correction to offset the estimated disturbance;

whereby the rotating speed of the rolls is controlled on the basis of a value obtained by adding the correction calculated by the first disturbance compensator to the rotating speed command provided by the first feedback loop, and the looping torque or the looping speed is controlled on the basis of a value obtained by adding the correction calculated by the second disturbance compensator to the looping torque command or looping speed command provided by the second feedback loop. The first object of the invention can be achieved by this interstand tension controller.

In a second aspect of the present invention, an interstand tension controller for a continuous rolling mill having a plurality of rolling stands and provided with a looper between the adjacent rolling stands comprises:

a first feedback loop that measures or estimates the interstand tension of the workpiece, calculates a rotating speed command specifying a desired rotating speed for the rolls of the rolling stand on the basis of the difference between a desired interstand tension, and a measured or estimated working interstand tension, and corrects the rotating speed commands;

a second feedback loop that measures the looping angle, calculates a looping torque command specifying a desired looping torque or a looping speed command specifying a desired looping speed on the basis of the difference between the measured looping angle and a desired looping angle;

a first disturbance compensator that estimates a disturbance acting on the first feedback loop on the basis of the difference between an estimated tension obtained by applying a sum of the rotating speed command calculated by the first feedback loop and a rotating speed correction calculated by the first disturbance compensator to a model that receives the rotating speed command and provides the interstand tension, and the measured or estimated working interstand tension, and calculates the rotating speed correction to offset the estimated disturbance; and a second disturbance compensator that estimates a disturbance acting on the second feedback loop on the basis of the difference between an estimated looping speed obtained by applying a sum of the looping torque command or the looping speed command calculated by the second feedback loop and a looping torque correction or a looping speed correction calculated by the second disturbance compensator to a model that receives the looping torque command or the looping speed command and provides a looping speed, and a measured looping speed, and calculates the looping torque correction or the looping speed correction to offset the estimated disturbance;

whereby the rotating speed of the rolls is controlled on the basis of a value obtained by adding the correction calculated by the first disturbance compensator to the rotating speed command provided by the first feedback loop, and the looping torque or the looping speed is controlled on the basis of a value obtained by adding the correction calculated by the second disturbance compensator to the looping torque command or the looping speed command provided by the second feedback loop. The first object of the invention can be achieved by this interstand tension controller.

In a third aspect of the present invention, an interstand tension controller for a continuous rolling mill having a plurality of rolling stands and provided with a looper between the adjacent rolling stands comprises:

a first feedback loop that measures or estimates the interstand tension of the workpiece, calculates a rotating speed command specifying a desired rotating speed for the rolls of the rolling stand on the basis of the difference between a desired interstand tension, and a measured or estimated working interstand tension, and corrects the rotating speed command;

a second feedback loop that measures the looping angle, calculates a looping torque command or a looping speed command on the basis of the difference between a measured looping angle and a desired looping angle, and corrects the looping torque command or the looping speed command;

a first disturbance compensator that estimates a disturbance acting on the first feedback loop on the basis of the difference between an estimated tension obtained by applying the looping speed and a sum of the rotating speed command calculated by the first feedback loop and a rotating speed correction calculated by the first disturbance compensator to a model that receives the rotating speed command and the looping speed and provides an interstand tension, and the measured or estimated working interstand tension, and calculates the rotating speed correction to offset the estimated disturbance; and a second disturbance compensator that estimates a disturbance acting on the second feedback loop on the basis of an estimated looping angle obtained by applying a sum of the looping torque command or the looping speed command calculated by the second feedback loop and a looping torque correction or a looping speed correction calculated by the second disturbance compensator to a model that receives the looping torque command or the looping speed command and provides a looping angle, and the measured looping angle, and calculates the looping torque correction or the looping speed correction to offset the disturbance;

whereby the rotating speed of the rolls is controlled on the basis of a value obtained by adding the correction calculated by the first disturbance compensator to the rotating speed command provided by the first feedback loop, and the looping torque or the looping speed is controlled on the basis of a value obtained by adding the correction calculated by the second disturbance compensator to the looping torque command or the looping speed command provided by the second feedback loop. The second object of the invention can be achieved by this interstand tension controller.

In a fourth aspect of the present invention, an interstand tension controller for a continuous rolling mill having a plurality of rolling stands and provided with a looper between the adjacent rolling stands comprises:

a first feedback loop that measures or estimates the interstand tension of the workpiece, and calculates a rotating speed command for the rolls of the rolling stand on the basis of the difference between a desired interstand tension and the measured or estimated working interstand tension;

a second feedback loop that measures the looping angle, calculates a looping torque command or a looping speed command on the basis of the difference between the measured looping angle and a desired looping angle, and corrects the looping torque command or the looping speed command;

a first disturbance compensator that estimates a disturbance acting on the first feedback loop on the basis of the difference between an estimated tension obtained by applying the looping speed command and a sum of the rotating speed calculated by the first feedback loop and a rotating speed correction calculated by the first disturbance compensator to a model that receives the rotating speed command and the looping speed and provides the interstand tension, and the measured or estimated working interstand tension, and calculates the rotating speed correction to offset the estimated disturbance; and a second disturbance compensator that estimates a disturbance acting on the second feedback loop on the basis of the difference between an estimated looping speed obtained by applying a sum of the looping torque command or the looping speed command calculated by the second feedback loop and a looping torque correction or a looping speed correction calculated by the second disturbance compensator to a model that receives the looping torque command or the looping speed command and provides a looping speed, and a measured looping speed, and calculates the looping torque correction or the looping speed correction to offset the disturbance;

whereby the rotating speed of the rolls of the rolling stand is controlled on the basis of a value obtained by adding the correction calculated by the first disturbance compensator to the rotating speed command provided by the first feedback loop, and the looping torque or the looping speed is controlled on the basis of a value obtained by adding the correction calculated by the second disturbance compensator to the looping torque command or the looping speed command provided by the second feedback loop. The second object of the invention can be achieved by this interstand tension controller.

In a fifth aspect of the present invention, an interstand tension controller for a continuous rolling mill having a plurality of rolling stands and provided with a looper between the adjacent rolling stands comprises:

a feedback loop that calculates a rotating speed command specifying a desired rotating speed of the rolls of the rolling stand, and a looping torque command or a looping speed command on the basis of a measured or estimated interstand tension of the workpiece between the rolling stands, the deviation of the measured or estimated interstand tension from a desired interstand tension, a measured looping angle, the deviation of the measured looping angle from a desired looping angle, a measured rotating speed of the rolls of the rolling stand, and a measured looping speed, and corrects the rotating speed of the rolls of the rolling stand, and the looping torque or the looping speed;

a first disturbance compensator that estimates a disturbance acting on the feedback loop on the basis of the difference between an estimated interstand tension obtained by applying the sum of the rotating speed command calculated by the feedback loop and a rotating speed correction calculated by the first disturbance compensator, and the measured looping speed to a model that receives the rotating speed command and provides an interstand tension of the workpiece, and the measured or estimated interstand tension, and calculates the rotating speed correction to offset the disturbance; and a second disturbance compensator that estimates a disturbance acting on the feedback loop on the basis of the difference between an estimated looping angle obtained by applying the sum of the looping torque command or the looping speed command calculated by the feedback loop and a looping torque correction calculated by the second disturbance compensator and the measured or estimated interstand tension to a model that receives the looping torque command or the looping speed command and provides a looping angle, and the measured looping angle, and calculates the looping torque correction or a looping speed correction to offset the disturbance;

whereby the rotating speed of the rolls of the rolling stand is controlled on the basis of the sum of the rotating speed command calculated by the feedback loop and the rotating speed correction calculated by the first disturbance compensator, and the looping torque or the looping speed is controlled on the basis of the sum of the looping torque command or the looping speed command calculated by the feedback loop and the looping torque correction or the looping speed correction calculated by the second disturbance compensator. The third object of the present invention can be achieved by this interstand tension controller.

In a sixth aspect of the present invention, an interstand tension controller for a continuous rolling mill having a plurality of rolling stands and provided with a looper between the adjacent rolling stands comprises:

a feedback loop that calculates a rotating speed command specifying a desired rotating speed of the rolls of the rolling stand, and a looping torque command or a looping speed command on the basis of a measured or estimated interstand tension of the workpiece between the rolling stands, the deviation of the measured or estimated interstand tension from a desired interstand tension, a measured looping angle, the deviation of the measured looping angle from a desired looping angle, the measured rotating speed of the rolls of the rolling stand, and the measured looping speed, and corrects the rotating speed, and the looping torque or the looping speed;

a first disturbance compensator that estimates a disturbance acting on the feedback loop on the basis of the difference between an estimated interstand tension obtained by applying the sum of the rotating speed command calculated by the feedback loop and a rotating speed correction calculated by the first disturbance compensator, and the measured looping speed to a model that receives the rotating speed command and provides the interstand tension of the workpiece between the rolling stands, and the measured or estimated interstand tension, and calculates a rotating speed correction to offset the estimated disturbance; and a second disturbance compensator that estimates a disturbance acting on the feedback loop on the basis of the difference between an estimated looping speed obtained by applying the sum of the looping torque command or the looping speed command calculated by the feedback loop and a looping speed correction calculated by the second disturbance compensator, and the measured or estimated interstand tension to a model that receives the looping torque command or the looping speed command and provides a looping speed, and the measured looping speed, and calculates the looping speed correction to offset the disturbance;

whereby the rotating speed is controlled on the basis of the sum of the rotating speed command calculated by the feedback loop and the rotating speed correction calculated by the first disturbance compensator, and the looping torque or the looping speed is controlled on the basis of the sum of the looping torque command or the looping speed command calculated by the feedback loop and the looping torque correction or the looping speed correction calculated by the second disturbance compensator. The third object of the present invention can be achieved by this interstand tension controller.

In a seventh aspect of the invention, a method of controlling the interstand tension of a workpiece being rolled on a continuous rolling mill having a plurality of rolling stands and provided with a looper between the adjacent rolling stands by regulating the rotating speed of the rolls of the rolling stand so that the interstand tension of the workpiece coincides with a desired interstand tension and controlling the looping angle by regulating the looping torque or the looping speed of the looper so that the looping angle coincides with a desired looping angle comprises the steps of:

estimating a disturbance acting on a first controlled system, in which the rotating speed of the rolls is a manipulated variable and the interstand tension is a controlled variable, on the basis of the difference between an estimated interstand tension obtained by applying a rotating speed command to a model that receives the rotating speed command and provides an interstand tension, and a measured or estimated working interstand tension;

calculating a rotating speed command to offset the estimated disturbance;

regulating the rotating speed according to the calculated rotating speed command;

estimating a disturbance acting on a second controlled system, in which the looping torque or the looping speed is a manipulated variable and looping angle is a controlled variable, on the basis of the difference between an estimated looping angle obtained by applying a looping torque command or a looping speed command to a model that receives the looping torque command or the looping speed command and provides a looping angle, and a measured looping angle;

calculating a looping torque command or a looping speed command to offset the estimated disturbance; and regulating the looping torque or the looping speed according to the calculated looping torque command or the calculated looping speed command. The first object of the invention can be achieved by this method of controlling the interstand tension.

In an eighth aspect of the present invention, a method of controlling the interstand tension of a workpiece being rolled on a continuous rolling mill having a plurality of rolling stands and provided with a looper between the adjacent rolling stands by regulating the rotating speed of the rolls of the rolling stand so that the interstand tension of the workpiece coincide with a desired interstand tension and controlling the looping angle by regulating the looping torque or the looping speed of the looper so that the looping angle coincides with a desired looping angle comprises the steps of:

estimating a disturbance acting on a first controlled system, in which the rotating speed of the rolls is a manipulated variable and the interstand tension is a controlled variable, on the basis of the difference between an estimated interstand tension obtained by applying a rotating speed command to a model that receives a rotating speed command and provides an interstand tension, and a measured or estimated working interstand tension;

calculating a rotating speed command to offset the disturbance;

regulating the rotating speed of the rolls according to the calculated rotating speed command;

estimating a disturbance acting on a second controlled system, in which the looping torque or the looping speed is a manipulated variable and the looping angle is a controlled variable, on the basis of the difference between an estimated looping speed obtained by applying a looping torque command or a looping speed command to a model that receives the looping torque command or the looping speed command and provides a looping speed, and a measured looping speed;

calculating a looping torque command or a looping speed command to offset the disturbance; and regulating the looping torque or the looping speed according to the calculated looping torque command or the calculated looping speed command. The first object of the invention can be achieved by this method of controlling the interstand tension.

In a ninth aspect of the present invention, a method of controlling the interstand tension of a workpiece being rolled on a continuous rolling mill having a plurality of rolling stands and provided with a looper between the adjacent rolling stands by regulating the rotating speed of the rolls of the rolling stand so that the interstand tension of the workpiece coincides with a desired interstand tension and controlling the looping angle by regulating the looping torque or the looping speed of the looper so that the looping angle coincides with a looping angle comprises the steps of:

estimating a disturbance acting on a first controlled system, in which the rotating speed of the rolls is a manipulated variable and the interstand tension is a controlled variable, on the basis of the difference between an estimated interstand tension obtained by applying a rotating speed command and a looping speed to a model that receives the rotating speed command and the looping speed and provides an interstand tension, and a measured or estimated working interstand tension;

calculating a rotating speed command to offset the disturbance;

regulating the rotating speed according to the calculated rotating speed command;

estimating a disturbance acting on a second controlled system, in which the looping torque or the looping speed is a manipulated variable and the looping angle is a controlled variable, on the basis of the difference between an estimated looping angle obtained by applying a looping torque command or a looping speed command to a model that receives the looping torque command or the looping speed command and provides a looping angle, and a measured looping angle;

calculating a looping torque command or a looping speed command to offset the disturbance; and regulating the looping torque or the looping speed according to the calculated looping torque command or the calculated looping speed command. The second object of the invention can be achieved by this method of controlling the interstand tension.

In a tenth aspect of the present invention, a method of controlling the interstand tension of a workpiece being rolled on a continuous rolling mill having a plurality of rolling stands and provided with a looper between the adjacent rolling stands by regulating the rotating speed of the rolls of the rolling stand so that the interstand tension of the workpiece coincides with a desired interstand tension and controlling the looping angle by regulating the looping torque or the looping speed of the looper so that the looping angle coincides with a desired looping angle comprises the steps of:

estimating a disturbance acting on a first controlled system, in which the rotating speed of the rolls is a manipulated variable and the interstand tension is a controlled variable, on the basis of the difference between an estimated interstand tension obtained by applying a rotating speed command and a looping speed to a model that receives the rotating speed command and the looping speed and provides an interstand tension, and a measured or estimated working interstand tension of the workpiece;

calculating a rotating speed command to offset the disturbance;

controlling the rotating speed of the rolls according to the calculated rotating speed command;

estimating a disturbance acting on a second controlled system, in which the looping torque or the looping speed is a manipulated variable and the looping angle is a controlled variable, on the basis of the difference between an estimated looping speed obtained by applying a looping torque command or a looping speed command to a model that receives the looping torque command or the looping speed command and provides a looping speed, and a measured looping speed;

calculating a looping torque command or a looping speed command to offset the disturbance; and regulating the looping torque or the looping speed according to the calculated looping torque command or the calculated looping speed command. The second object of the invention can be achieved by this method of controlling the interstand tension.

As shown in FIGS. 3 and 4, each of the interstand tension controllers in the first to the fourth aspect of the present invention, similarly to a conventional noninteractive interstand tension controller, comprises the first feedback loop that measures or estimates the interstand tension of the workpiece, calculates a rotating speed command specifying a desired rotating speed of the rolls of the roll stand on the basis of the difference between a desired interstand tension and the measured or estimated working interstand tension, and corrects the rotating speed of the rolls, and a second feedback loop that measures the looping angle, calculates a looping torque command or a looping speed command on the basis of the difference between the measured looping angle and a desired looping angle and corrects the looping torque or the looping speed.

The interstand tension controllers in the first to the fourth aspect of the present invention differ from the conventional noninteractive interstand tension controller in that the two disturbance compensators estimate a disturbance acting on the two feedback loops and add signals capable of offsetting the disturbance to the signals provided by the feedback loops. The disturbance includes an equivalent disturbance such as the variation of the characteristics of the controlled system resulting from the variation of parameters such as the Young's modulus of the workpiece, in addition to the influence of interaction between the feedback loops, and the variation of the rolling speed due to the variation of the thickness or the temperature of the workpiece.

In the interstand tension controllers in the first to the fourth aspect of the present invention, interactions between the two feedback loops are compensated by the disturbance offsetting signals provided by the two disturbance compensators and the two feedback loops can individually be designed. Therefore, the interstand tension controllers can easily be designed and are highly resistant to disturbances, such as the variation of the rolling speed, and the variation of the characteristics of the controlled system.

In the interstand tension controller in the fifth and the sixth aspect of the present invention, when there is a feedback loop which receives a plurality of measurable quantities as shown in FIGS. 5 and 6, the two disturbance compensators estimate the disturbances acting on the feedback loop, and add correction signals to offset the disturbances to signals calculated by a feedback control system. When such a feedback loop that receives a plurality of measurable quantities is included, the interference between the tension and the looping angle need not be offset by the corrections provided by the disturbance compensators because the interference between the tension and the looping angle is controlled by the feedback loop. Therefore, the looping speed is applied to the model that receives the rotating speed command and provides the interstand tension of the workpiece, and the measured tension is applied to the model that receives the looping torque command or the looping speed command and provides the looping speed so that the disturbance compensators will not provide any corrections to offset the interference. Accordingly, the disturbances, here, include variation of the rolling speed due to the variation of the thickness and the temperature of the workpiece, and the variation of the characteristics of the controlled system resulting from the variation of parameters, such as the variation of the Young's modulus of the workpiece.

Even if there is a feedback loop that receives a plurality of measurable quantities as in the fifth and the sixth aspect of the present invention, a control system is resistant to the disturbances and the variation of the characteristics of the controlled system by using the two disturbance compensators.

The second disturbance compensator of the interstand tension controller in the first aspect of the present invention shown in FIG. 3 uses the estimated looping angle obtained by applying the sum of the looping torque command or the looping speed command calculated by the second feedback loop and the correction calculated by the second disturbance compensator to the model that receives the looping torque command or the looping speed command and provides a looping angle, and the measured looping angle for estimating the disturbance acting on the second feedback loop. On the other hand, the interstand tension controller in the second aspect of the present invention shown in FIG. 4 uses the estimated looping speed and the measured looping speed for estimating the disturbance acting on the second feedback loop; that is the model of the looper and the disturbance compensators of the interstand tension controller in the first aspect of the present invention are modified by using an expression:

$$\theta=(1/s)\omega \tag{1}$$

where $\theta$ is the looping angle and $\omega$ is the looping speed. Accordingly, although the interstand tension controllers in the first and the second aspects of the present invention are the same in function, the configuration of the interstand tension controller in the second aspect of the present invention is simpler than that of the interstand tension controller in the first aspect of the present invention, and the order of the model of the looper and the filter of the interstand tension controller in the second aspect of the present invention is lower than that of the same of the interstand tension controller in the first aspect of the present invention.

The relation between the third and the fourth aspects of the present invention and the relation between the fifth and the sixth aspects of the present invention are the same as the relation between the first and the second aspects of the present invention.

In the first to the fourth aspects of the present invention, the feedback loop for controlling the interstand tension through the control of the rotating speed of the rolls of the rolling stand and the feedback loop for controlling the looping angle through the control of the looping torque or the looping speed are used for adjusting the two controlled variables of the interstand tension of the workpiece and the looper to the corresponding desired values, interactions between the two feedback loops are compensated by the disturbance compensating signals provided by the two disturbance compensators, and the two feedback loops can individually be designed. Therefore, the interstand tension controller can easily be designed and is highly resistant to disturbances, such as the variation of the rolling speed and the variation of the characteristics of the controlled system. Further, even if there is a feedback loop that receives a plurality of measurable quantities as in the fifth and the sixth aspects of the present invention, a control system is resistant to the disturbances and the variation of the characteristics of the controlled system by using the two disturbance compensators. Consequently, the workpiece can be rolled in a satisfactory shape and correct dimensions, and the rolling operation can be stabilized.

The methods of controlling the interstand tension of a workpiece being rolled on a continuous rolling mill in the seventh to the tenth aspects of the present invention regulate the rotating speed of the rolls of the rolling stand to adjust the interstand tension of the workpiece to a desired interstand tension, and regulates the looping torque or the looping speed to adjust the looping angle to a desired looping angle as shown in FIGS. 7 and 8. In this control operation, a disturbance acting on the controlled system, in which the rotating speed is a manipulated variable and the interstand tension is a controlled variable, is estimated on the basis of the difference between an estimated interstand tension obtained by applying a rotating speed command to the model that receives the rotating speed command and provides the interstand tension of the workpiece, and the measured or estimated working interstand tension of the workpiece, a rotating speed command to offset the disturbance is calculated and the rotating speed of the rolls is regulated according to the calculated rotating speed command.

In the seventh aspect of the present invention, as shown in FIG. 7, a disturbance acting on the controlled system, in which the looping torque or the looping speed is a manipulated variable and the looping angle is a controlled variable, is estimated on the basis of the difference between an estimated looping angle obtained by applying a looping torque command or a looping speed command to a model that receives the looping torque or the looping speed and provides an interstand tension, and a measured looping angle, a looping torque command or a looping speed command capable of offsetting the disturbance is calculated, and the looping torque or the looping speed is regulated according to the calculated looping torque or the calculated looping speed.

As mentioned above, the interstand tension and the looping angle interact with each other. In the seventh to the tenth aspects of the present invention, the interactive components are regarded as a disturbance acting on the two control loops, the disturbance is estimated on the basis of the difference between the respective outputs of the control loops and the models arranged in parallel to the controlled systems, respectively, and a signal capable of offsetting the disturbance is calculated and used as commands for regulating the manipulated variables. Thus, the disturbance acting on the control loops is offset and the control operation can stably be carried out. The disturbance includes an equivalent disturbance, variations in the characteristics of the controlled systems resulting from the variation of parameters such as the Young's modulus of the workpiece in addition to the variation of the rolling speed due to the variation of the thickness or the temperature of the workpiece. These disturbances can be suppressed by the methods in the seventh to the tenth aspects of the present invention. Thus, the interstand tension controllers in the seventh to the tenth aspects of the present invention regard interaction between the two control loops as a disturbance, estimate the same, and compensate for the same to enable the two control loops to be designed individually. Accordingly, the two feedback loops can easily be designed, and the controller is highly resistant to disturbances including the variation of the rolling speed, and the variation of the characteristics of the controlled systems.

In the eighth aspect of the present invention, as shown in FIG. 8, a disturbance acting on the controlled system, in which the looping torque or the looping speed is a manipulated variable and the looping angle is a controlled variable, is estimated on the basis of the difference between an estimated looping speed obtained by applying a looping torque command or a looping speed command to a model that receives the looping torque command or the looping speed command and provides a looping speed, and a measured looping speed, a looping torque command or a looping speed command capable of offsetting the disturbance is calculated, and the looping torque or the looping speed is regulated according to the calculated looping torque command or the calculated looping speed command. In the eighth aspect of the present invention, the estimated looping speed and the measured looping speed are used to estimate the disturbance acting on the controlled system, in which the looping torque or the looping speed is a manipulated variable and the looping angle is a controlled variable; that is, the model of the looper system and the filter in the seventh aspect of the present invention are modified by using expression (1). Accordingly, although the interstand tension controllers in the seventh and the eighth aspect of the present invention are the same in function, the configuration of the interstand tension controller in the eighth aspect of the present invention is simpler, than that of the controller in the seventh aspect of the present invention, and the order of the model of the looper and the filter in the eighth aspect of the present invention is lower than that of the same in the seventh aspect of the present invention, and hence the configuration of the interstand tension controller is simple.

As is obvious from FIG. 8, the method in the eighth aspect of the present invention regulates the looping speed at zero to maintain a looping angle constant and does not use any desired looping angle. However, the desired looping angle is not changed actually and it is sufficient to maintain a constant looping angle in practice.

According to the seventh to the tenth aspects of the present invention, in a continuous rolling mill having a plurality of rolling stands and provided with a looper between the adjacent rolling stands, the first control loop controls the interstand tension through the regulation of the rotating speed of the rolls of the rolling stand and the second control loop controls the looping angle through the regulation of the looping torque or the looping speed to regulate the two controlled variables of the interstand tension of the workpiece and the looper at corresponding desired values, interaction between the two control loops is estimated as a disturbance, and the manipulated variables are regulated so as to offset the disturbance to compensate for the interaction between the two control loops. Accordingly, the two control loops can individually be designed, the design of the control loops is facilitated, and the interstand tension controller is highly resistant to disturbances such as the variation of the rolling speed, and the variation of the characteristics of the controlled system. Consequently, the workpiece can be rolled in a satisfactory shape and satisfactory dimensions and the rolling operation can stably be carried out.

While only the sum of the rotating speed command calculated by the first feedback loop and the correction calculated by the first disturbance compensator is applied to the model that provides the interstand tension of the workpiece in the first and the second aspect of the present invention, in the third and the fourth aspects of the present invention, the looping speed, too, is applied to the model. Further, while only the rotating speed command specifying a rotating speed of the rolls of the rolling stand is applied to the model in the fifth and the sixth aspect of the present invention, in the seventh and the eighth aspect of the present invention, the looping speed, too, is applied to the model.

Although the interstand tension and the looping angle interact with each other as mentioned above, the looper operates to absorb variations in the interstand tension when the interstand tension varies. Therefore, the range of variation of the interstand tension when the effect of interactions between the interstand tension and the looping angle is not completely removed is narrower than that when the effect of interactions is completely removed and the looping angle varies in a comparatively narrow range if the interstand tension and the looping angle interact properly with each other. That is, the stability of the interstand tension and the operation of the looper is enhanced by allowing appropriate interaction between the interstand tension and the looping angle instead of completely removing the effect of interaction between the interstand tension and the looping angle. In the third, the fourth, the seventh and the eighth aspect of the present invention, the looping speed is applied to the model that provides the interstand tension of the workpiece to adjust offsetting the interactions. When the effect of some of the interactions between the interstand tension and the operation of the looper is left unremoved, the stability of the interstand tension and the operation of the looper will further be enhanced.

These and other novel features and advantages of the present invention will become more apparent form the following detailed description of the preferred embodiments.

BRIEF DESCRIPTION OF THE DRAWINGS

The preferred embodiments will be described with reference to the accompanying drawings, wherein:

FIG. 11 is a block diagram of a model of a looper tension control system included in the foregoing embodiments:

FIG. 12 is a block diagram of an interstand tension control system in a seventh embodiment according to a fourth aspect of the present invention;

DESCRIPTION OF THE PREFERRED EMBODIMENTS

Figure 1:
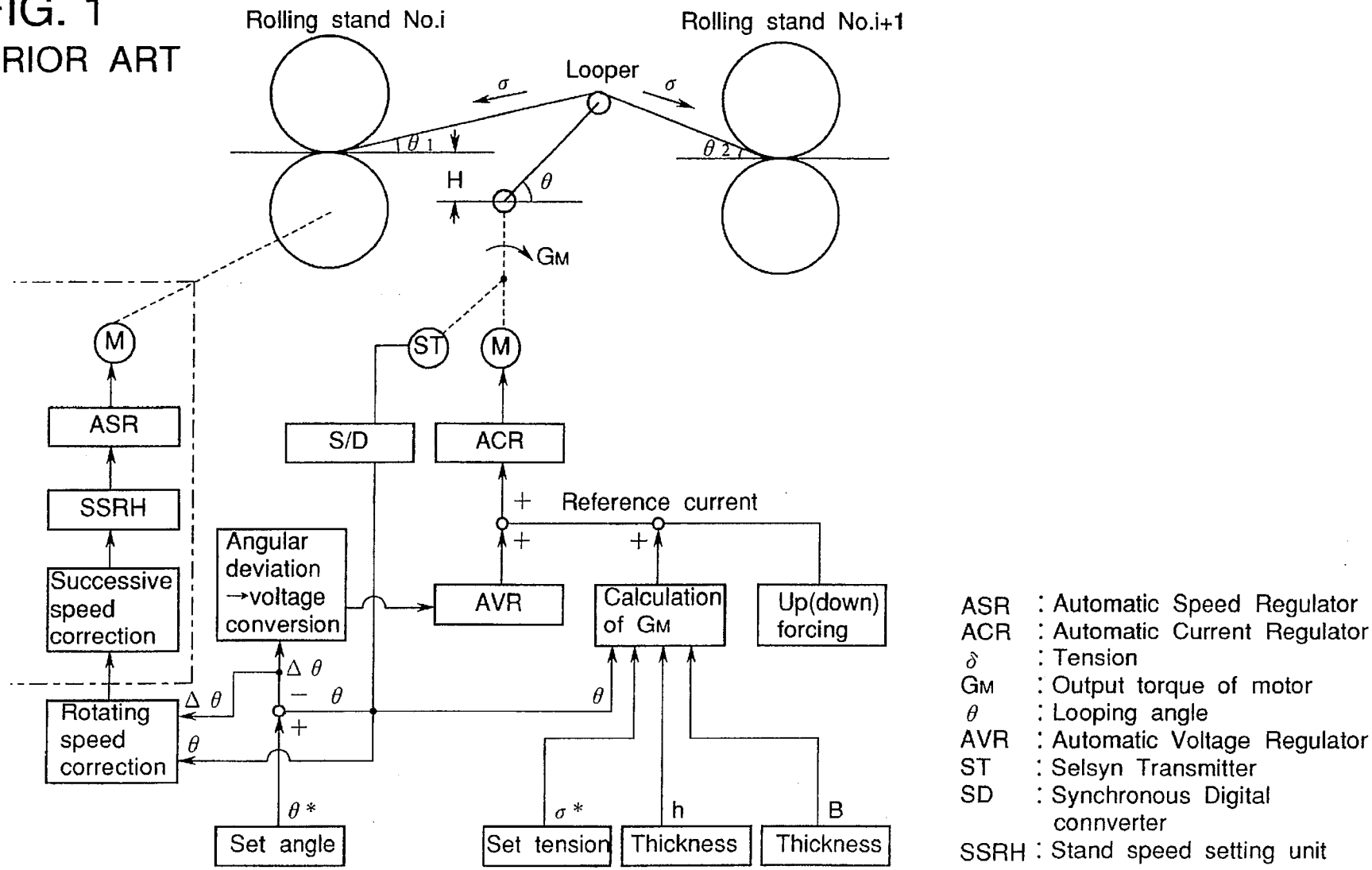
FIG. 1 PRIOR ART
FIG. 1 is a block diagram of a conventional looper controller.
Figure 2:
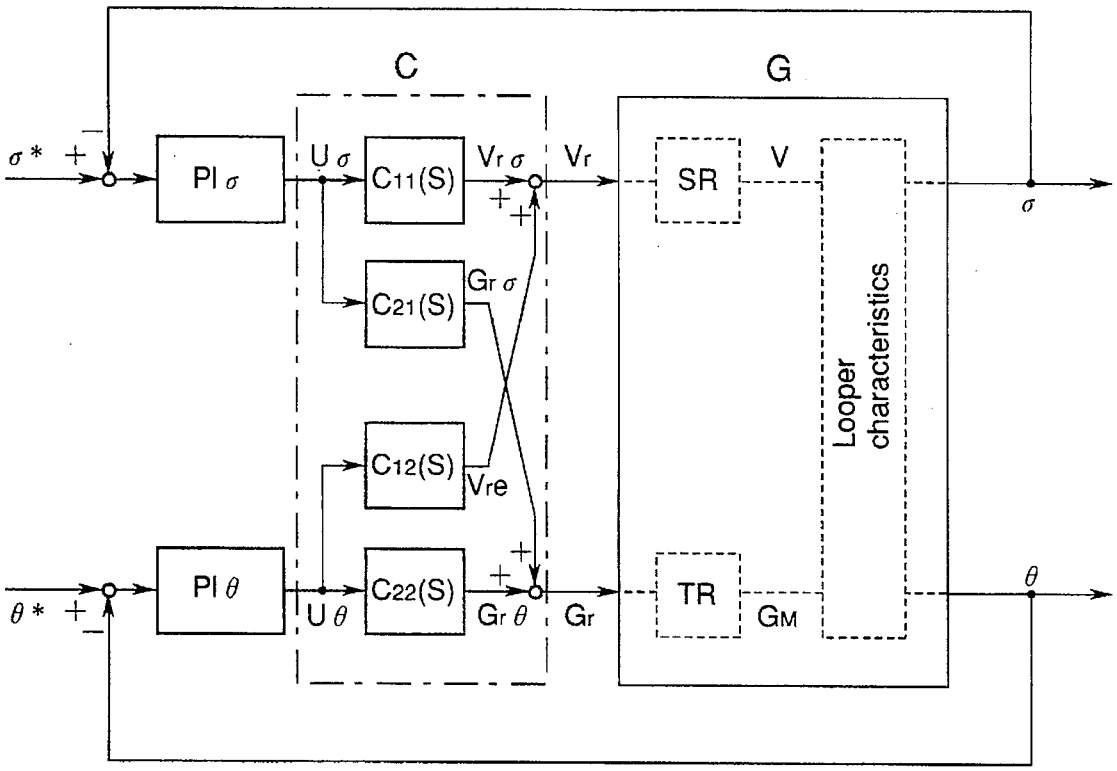
FIG. 2 PRIOR ART
FIG. 2 is a block diagram of a conventional noninteractive looper controller.
Figure 3:
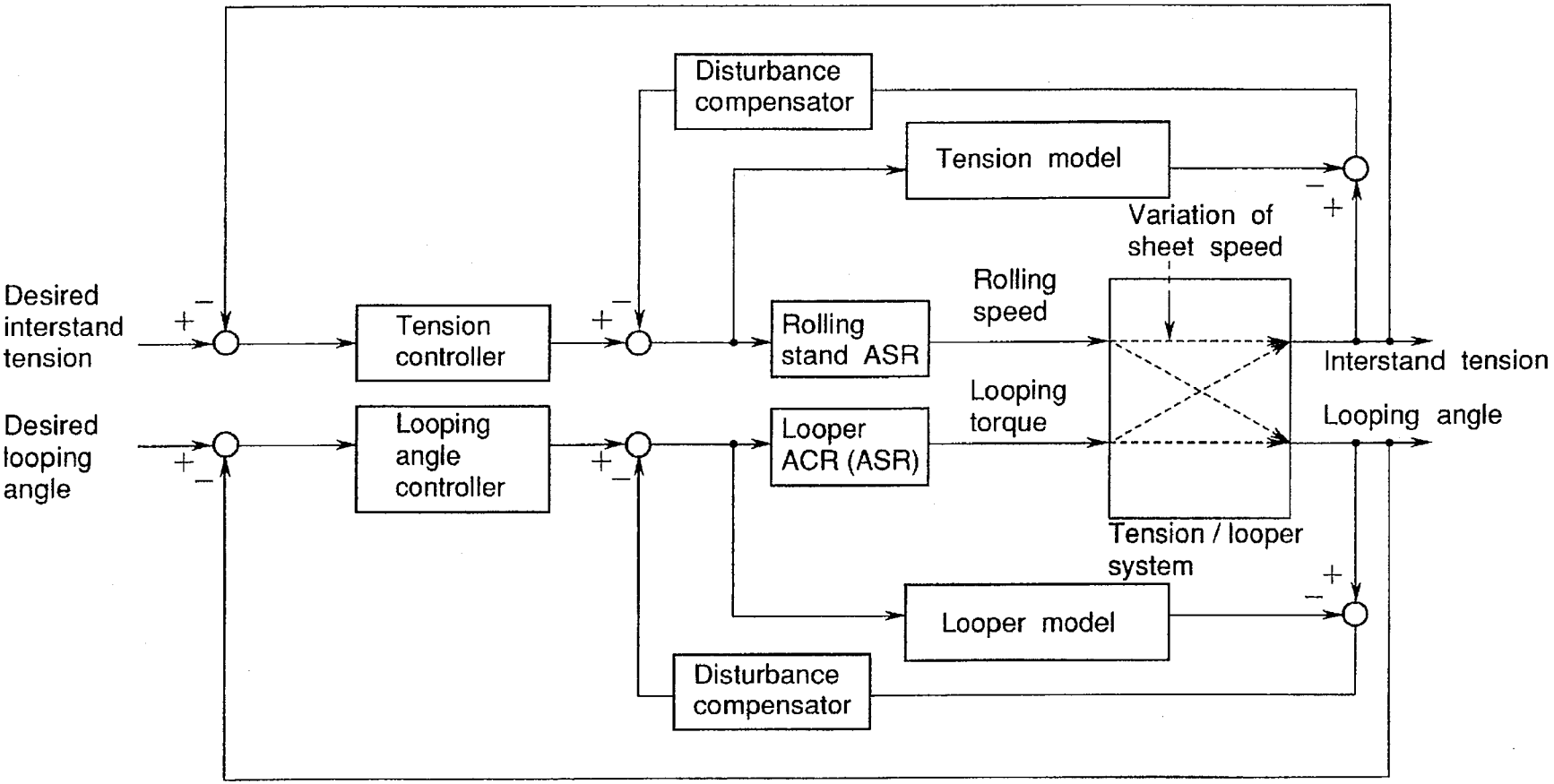
FIG. 3 is a block diagram showing the fundamental configuration of an interstand tension controller in a first aspect of the present invention.
Figure 4:
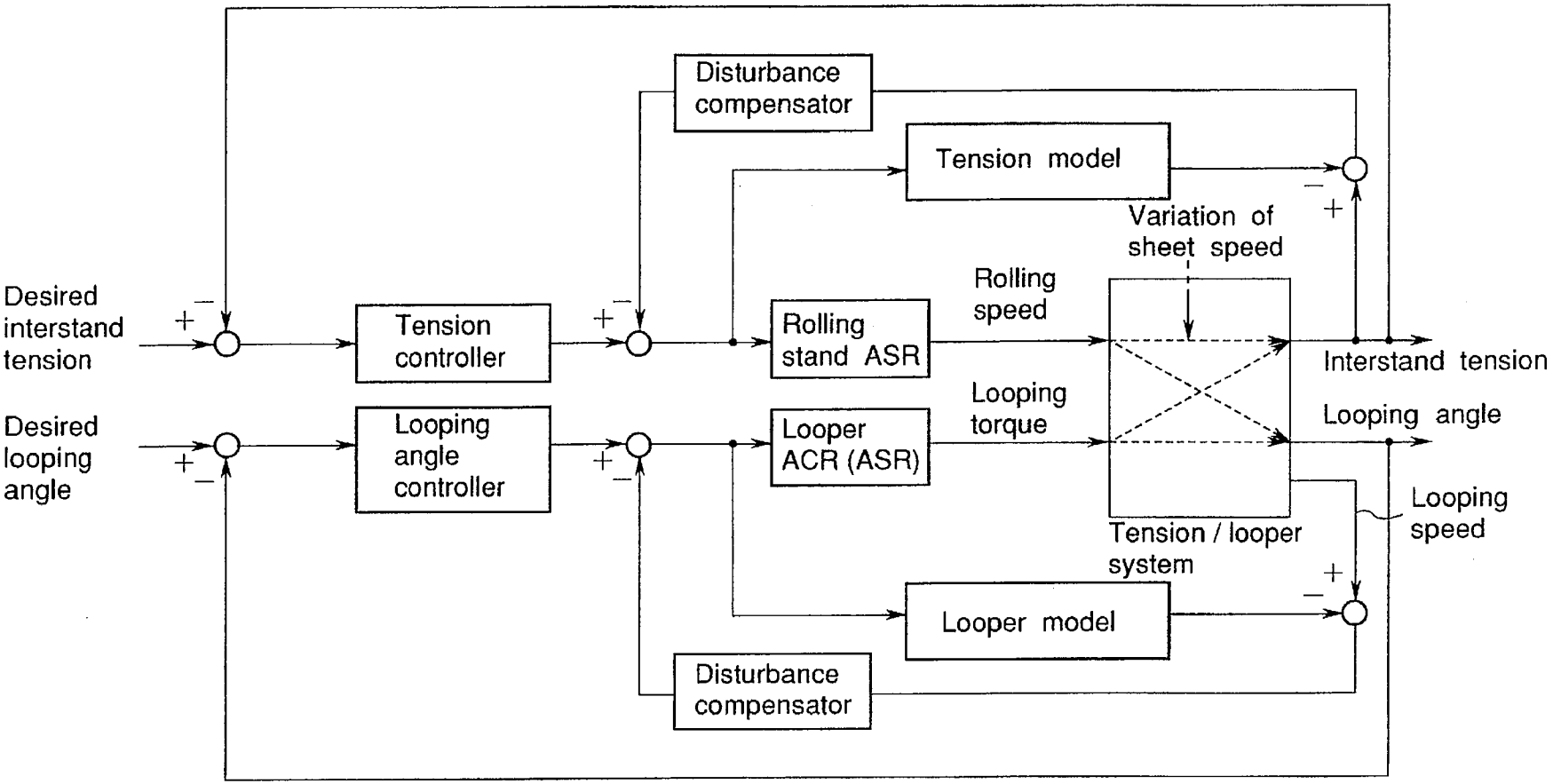
FIG. 4 is a block diagram showing the fundamental configuration of an interstand tension controller in a second aspect of the present invention.
Figure 5:
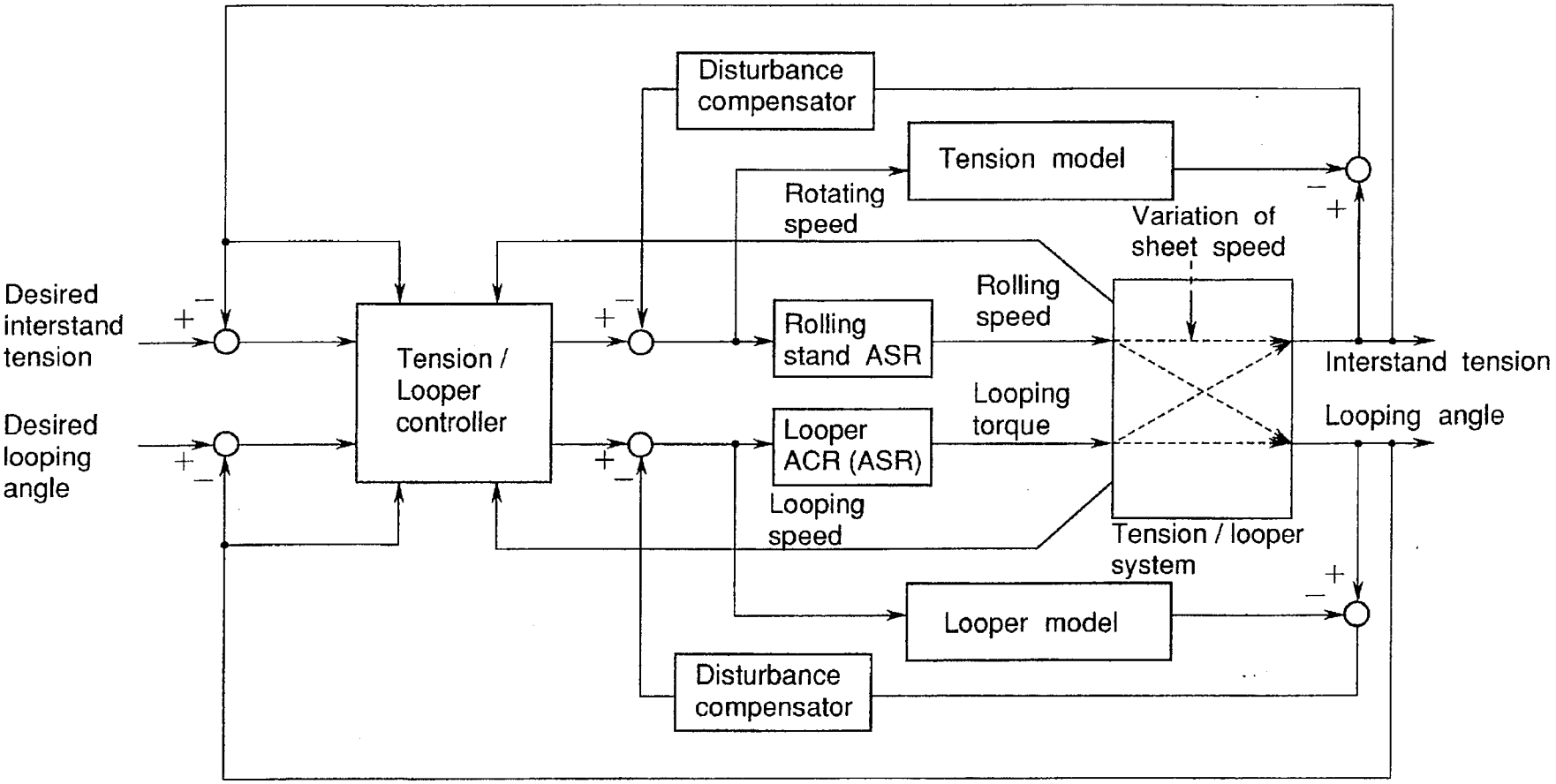
FIG. 5 is a block diagram showing the fundamental configuration of the interstand tension controller in the fifth aspect of the present invention.
Figure 6:
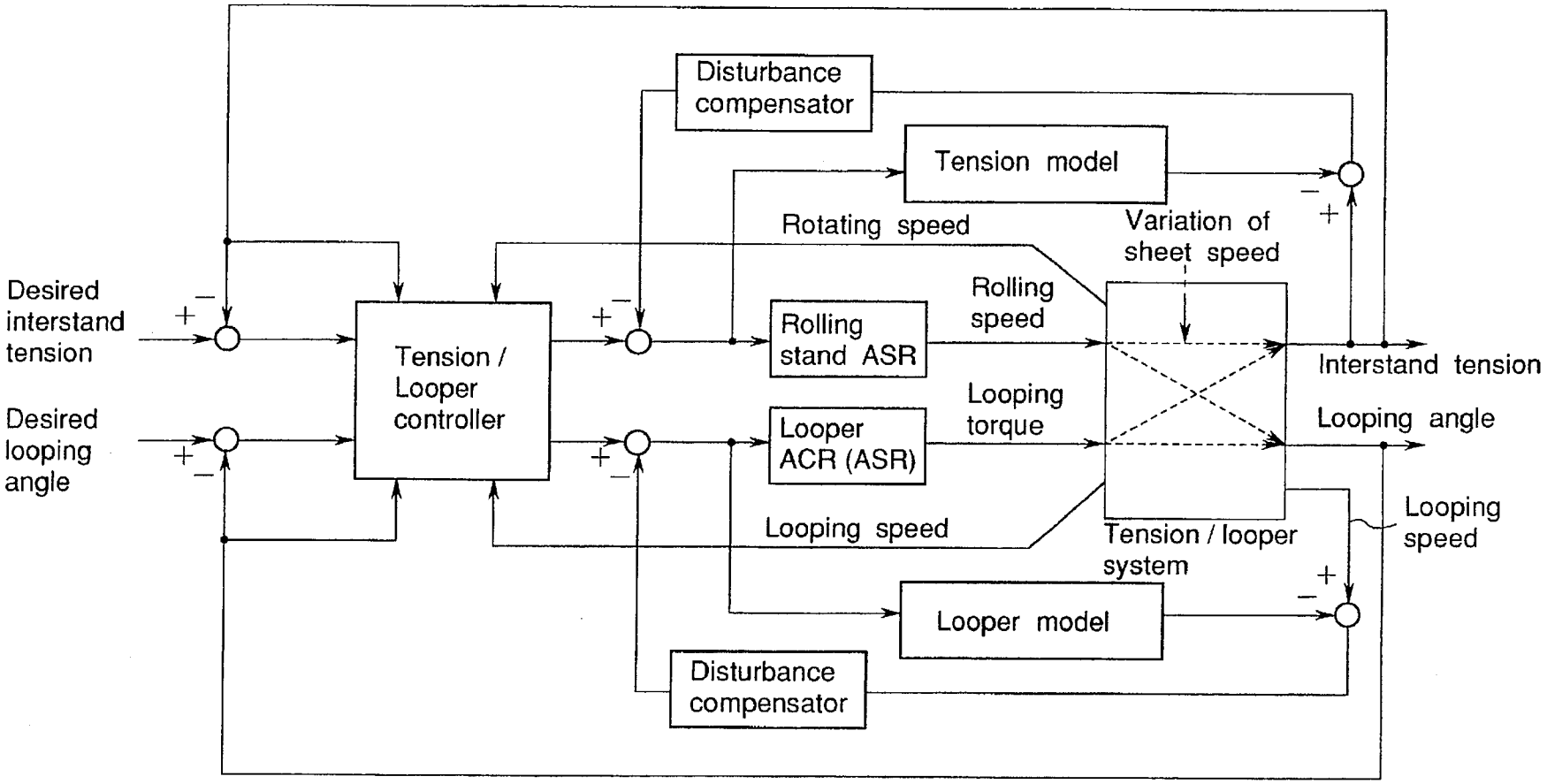
FIG. 6 is a block diagram showing the fundamental configuration of the interstand tension controller in the sixth aspect of the present invention.
Figure 7:
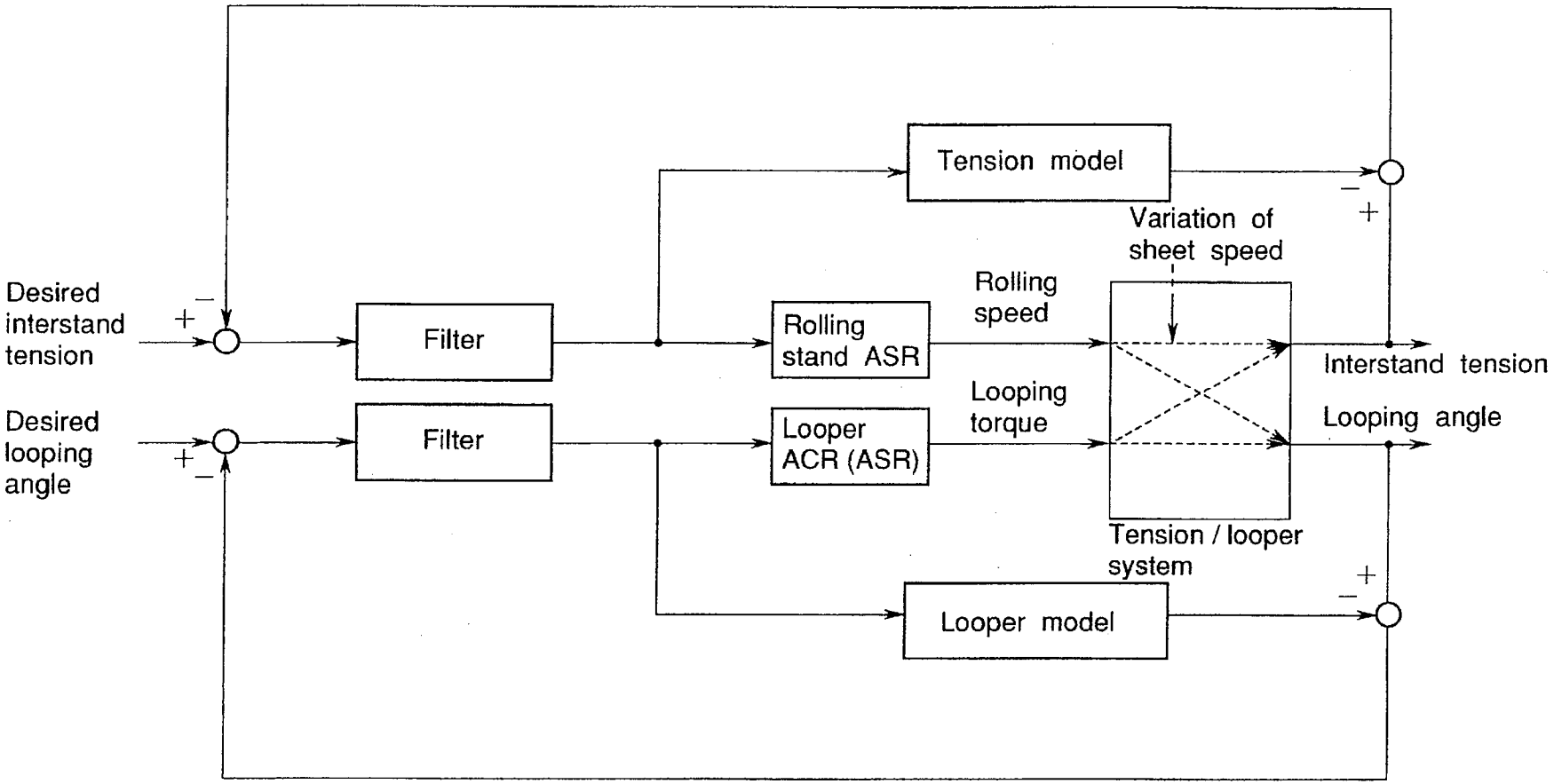
FIG. 7 is block diagram showing the fundamental configuration of the interstand tension controller in the seventh aspect of the present invention.
Figure 8:
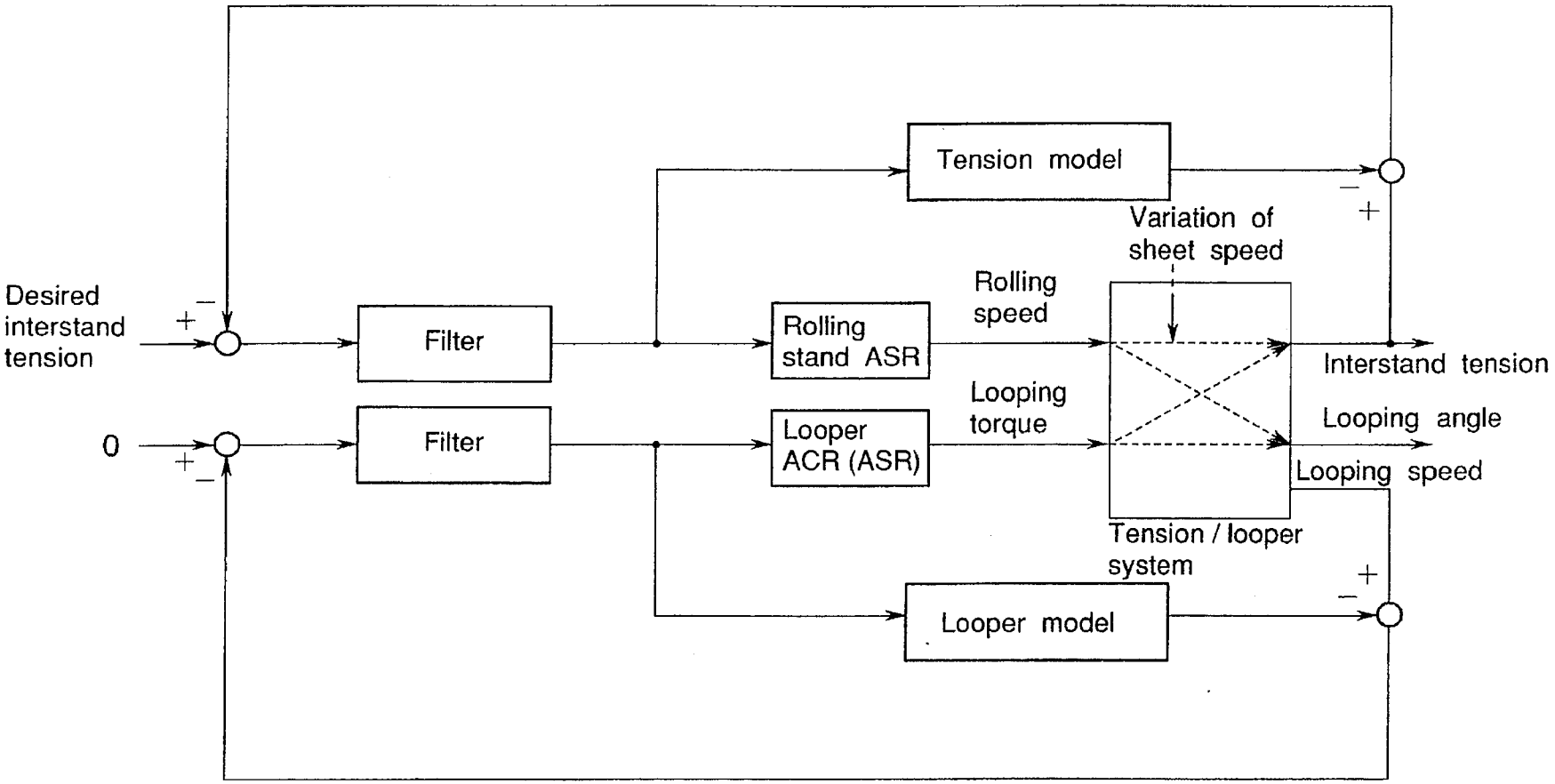
FIG. 8 is a block diagram showing the fundamental configuration of the interstand tension controller in the eighth aspect of the present invention.

Preferred embodiments of the present invention applied to controlling the interstand tension of a workpiece on a hot rolling mill and controlling the looper of the hot rolling mill will be described hereinafter with reference to the accompanying drawings, in which like or corresponding parts are denoted by the same reference numerals throughout.

First Embodiment

Figure 9:
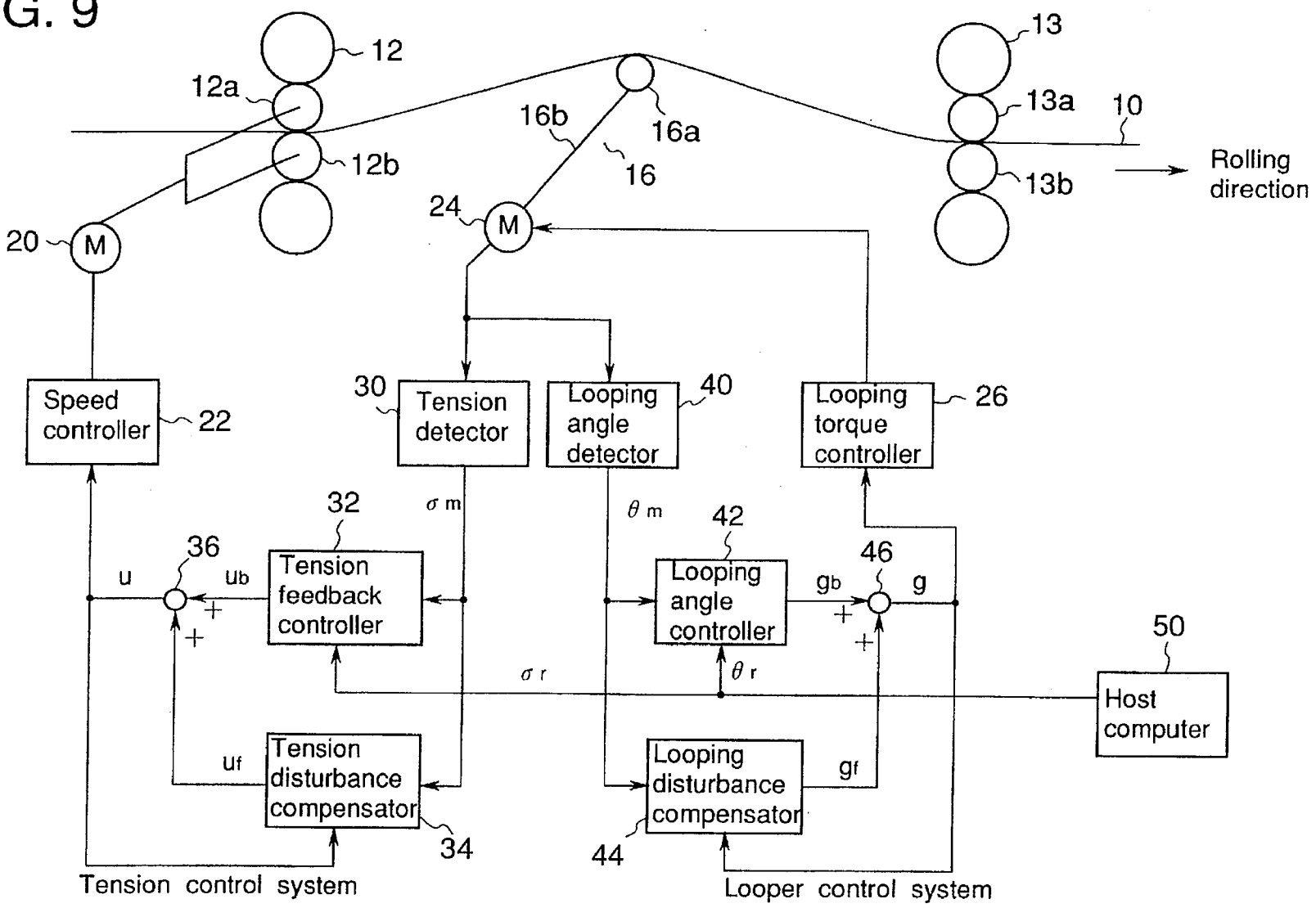
FIG. 9 is a block diagram of an interstand tension controller in a first embodiment according to the first aspect of the present invention as applied to hot rolling.

Referring to FIG. 9 showing an interstand tension controller in a first embodiment according to a first aspect of the the present invention as applied to the two adjacent rolling stands of a hot rolling mill, there are shown a workpiece 10, and two adjacent rolling stands 12 and 13 respectively having work rolls 12*a* and 12*b* and work rolls 13*a* and 13*b*. A motor 20 drives the work rolls 12*a* and 12*b*, and the motor 20 is controlled by a roll speed controller 22 so that the work rolls 12*a* and 12*b* are driven for rotation at a desired rotating speed. The workpiece 10 traveling from the left to the right in FIG. 9 is supported by a looper 16 having a looper arm 16*b* and a looper roller 16*a* supported for rotation on the free end of the looper arm 16*b*. The looper arm 16*b* has a base end operatively connected to a motor 24. The motor 24 is controlled by a looper torque controller 26 so as to generate a desired torque.

In a tension control system, a tension detector 30 receives a signal representing the reaction force of the workpiece 10 acting on the looper 16 from a load cell, not shown, installed on the looper 16 and calculates a measured tension $\sigma m$ of the workpiece 10, and then a tension feedback controller 32 calculates a rotating speed command ub on the basis of the difference between the measured tension $\sigma m$ and a desired tension $\sigma r$ specified by a host computer 50.

A tension disturbance compensator 34 internally provided with a model estimates a disturbance acting on the tension control system and calculates a rotating speed correction uf to offset the disturbance. An adder 36 adds up the rotating speed command ub and the rotating speed correction uf to give a corrected speed command u to the roll speed controller 22. The model of the tension disturbance compensator 34 receives the corrected speed command u, estimates the tension of the workpiece 10 on the basis of the corrected speed command u, regards the difference between the estimated tension and the measured tension $\sigma m$ given thereto by the tension detector 30 as a disturbance, and calculates the rotating speed correction uf to offset the disturbance.

Referring to FIG. 9, in a looper control system, a looping angle controller 42 calculates a looping torque command gb on the basis of the difference between a measured looping angle $\theta m$ measured by a looping angle detector 40 and a desired looping angle $\theta r$ received from the host computer 50.

A looper disturbance compensator 44 internally provided with a model estimates a disturbance acting on the looper control system and calculates a looping torque correction gf to offset the estimated disturbance. An adder 46 adds up the looping torque command gb and the looping torque correction gf and gives a corrected looping torque command g to a looping torque controller 26. The looper disturbance compensator 44 estimates the disturbance acting on the looper 16 on the basis of the difference between an estimated looping angle obtained by applying the corrected torque command g to its model and the measured looping angle $\theta m$ measured by the looping angle detector 40, and then calculates the looping torque correction gf to offset the estimated disturbance.

Second Embodiment

Figure 10:
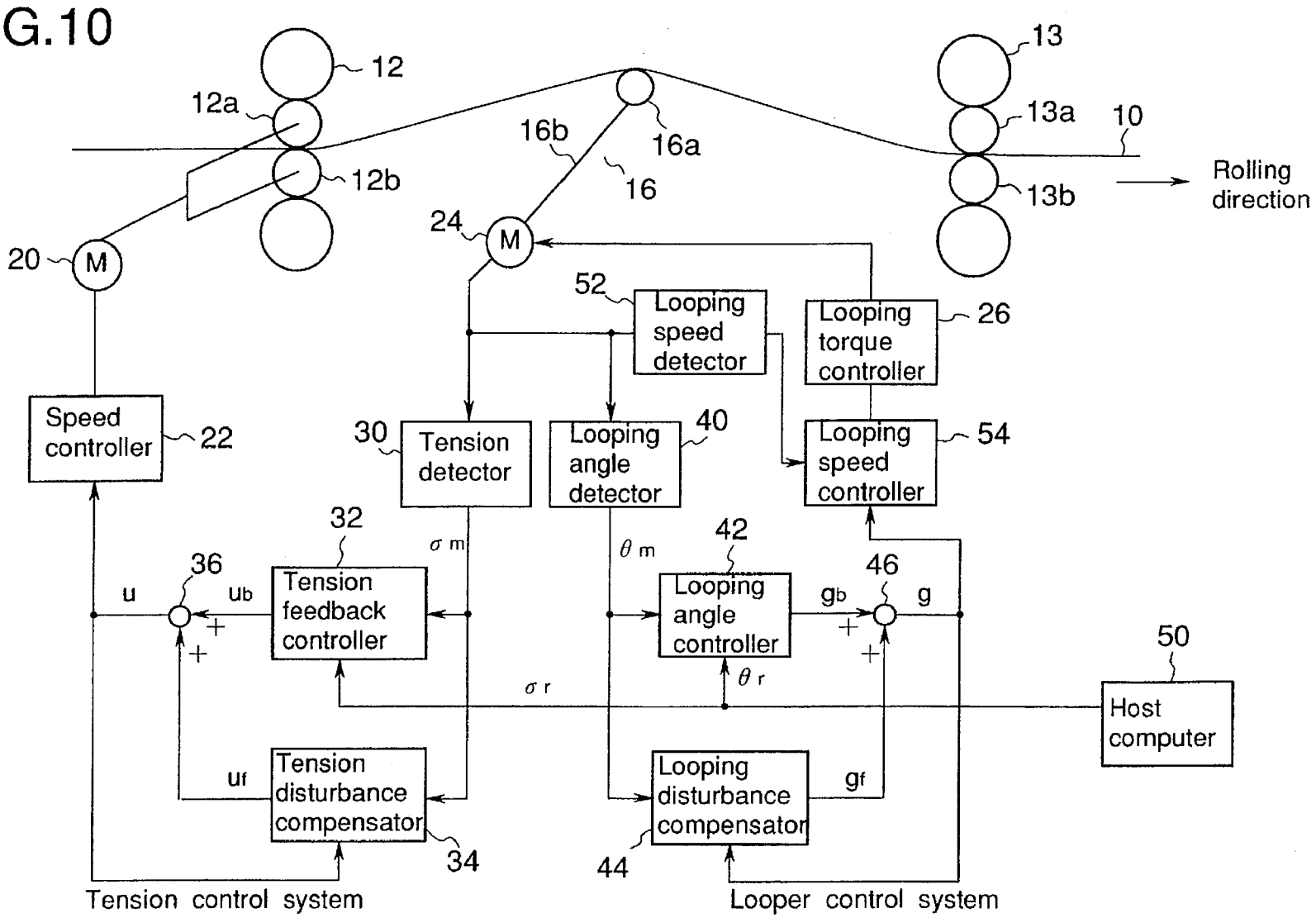
FIG. 10 is a block diagram of an interstand tension controller in a second embodiment according to the first aspect of the present invention.

Although the looping torque controller 26 of the interstand tension controller in the first embodiment controls the looping torque to regulate the looping angle, an interstand tension controller in a second embodiment according to the present invention includes a looping speed detector 52 for detecting looping speed and a looping speed controller 54 forming a looping speed control loop as shown in FIG. 10. The respective models and the filters of a tension disturbance compensator 34 and a looper disturbance compensator 44 will be described in detail.

The interstand tension of the workpiece on the hot rolling mill and the characteristics of the looper of the hot rolling mill are shown in FIG. 11 by way of example. In FIG. 11, Kgσ and Kgθ are influence coefficients indicating the influence of interactions between the interstand tension and the looping angle. A tension model and a looper model are produced by using transfer functions of a low order on an assumption that there is no influence of interactions between the tension and the looping angle. The models are expressed by the following expressions.

Tension model:

$$G\sigma=eKv/\{(s+eKv\sigma)(1+Tvs)\} \quad (2)$$

Looper model:

$$G\theta=1/\{s(1+T_{ASR}s)\} \quad (3)$$

Since interactions between the controlled systems and disturbances are not taken into consideration in producing expressions (2) and (3) representing the tension model and the looper model, an estimated tension and an estimated looping angle obtained by using expressions (2) and (3) are those under an ideal condition where there is neither disturbance nor interaction. Accordingly, the difference between an estimated value calculated by using each model and measured value representing the condition of the corresponding controlled system reflects the effect of interactions between the controlled systems, disturbances acting on the controlled system, and the difference in characteristics between the model and the actual controlled system.

In the tension system, the difference between the output of the tension model and an actual tension is expressed by:

$$\Delta\sigma=(P\sigma-G\sigma)u+P\sigma d \quad (4)$$

where Δσ is the difference between the output of the tension model and an actual tension, Pσ is the transfer constant of the tension system, u is a rotating speed command and d is a disturbance.

The characteristics of the filter Fσ is expressed by:

$$F\sigma=-1/G\sigma \quad (5)$$

The output of the filter Fσ corresponding to the tension difference a Δσ is the rotating speed correction uf, which is expressed by:

$$uf=-d \quad (6)$$

Since the rotating speed correction uf is the negative of the disturbance d, the disturbance can completely be offset by correcting the rotating speed command by the rotating speed correction uf. In this case, however, the complete offsetting of the disturbance is impossible owing to the significant influence of noise included in the measured tension. Therefore, a filter having characteristics Fσ expressed by the following expression is used.

$$F\sigma=-L/G\sigma \quad (7)$$

where L is the characteristics of a low-pass filter which determine disturbance suppressing characteristics.

Thus, the tension model, a subtracter that calculates the difference Δσ between the estimated tension calculated by the tension model and the measured tension, and the filter constitute the tension disturbance compensator 34.

The same configuration applies to the looper system; a looper model, a subtracter that calculates the difference between an estimated looping angle calculated by the looper model and a measured looping angle, and a filter constitute the looper disturbance compensator 44.

The follow-up performance of the interstand tension controller to follow up the desired tension and the desired looping angle is dependent on the performance of the tension feedback controller 32 and the looping angle controller 42.

Third Embodiment

Figure 12:
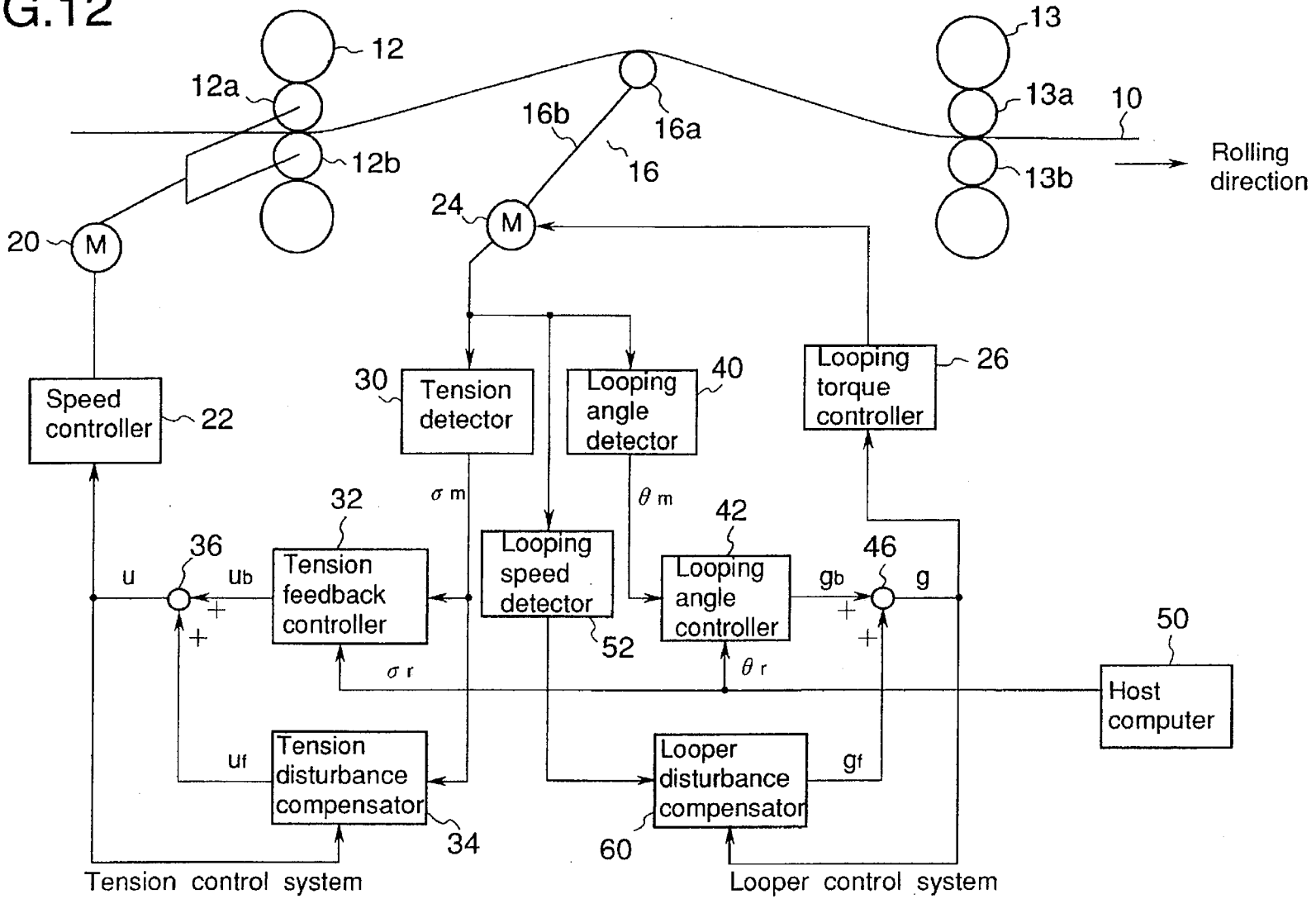
FIG. 12 is a block diagram of an interstand tension controller in a third embodiment according to the second aspect of the present invention as applied to hot rolling.

Referring to FIG. 12, an interstand tension controller in a third embodiment according to the present invention is provided with a looper disturbance compensator 60 internally provided with a looper model. The looper disturbance compensator 60 estimates a disturbance acting on a looper control system and calculates a looping torque correction gf to offset the estimated disturbance. An adder 46 adds up a looping torque command gb and the looping torque correction gf and gives a corrected looping torque command g to a looping torque controller 26. The looper model of the looper disturbance compensator 60 receives the corrected torque command g and provides an estimated looping speed, calculates the difference between the estimated looping speed and a measured looping speed, regards the difference as a disturbance acting on the looper system, and then calculates the looping torque correction gf to offset the estimated disturbance, i.e., the difference.

Fourth Embodiment

Figure 13:
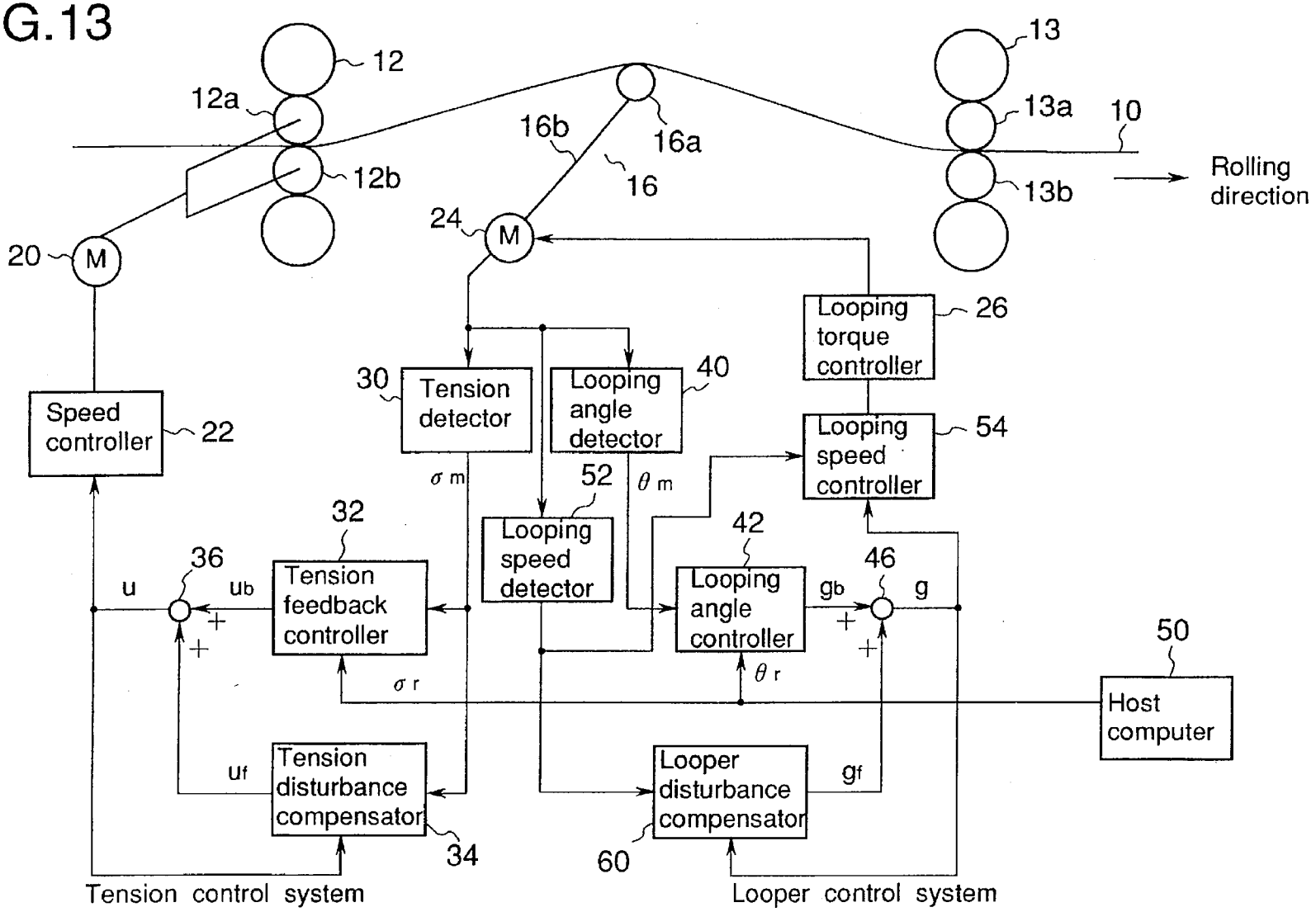
FIG. 13 is a block diagram of an interstand tension controller in a fourth embodiment according to the second aspect of the present invention.

The third embodiment regulates the looping angle by controlling the looping torque by the looping torque controller 26. An interstand tension controller in a fourth embodiment according to the present invention shown in FIG. 13 has a looping speed control loop including a looping speed detector 52 for detecting the looping speed, and a looping speed controller 54 that receives the output signal of the looping speed detector 52. From expressions (1) and (3), the looper model is expressed by:

$$G\theta(s)=1/(1+T_{ASR}s) \quad (8)$$

Whereas the looper model of the interstand tension controller in the second embodiment is expressed by a quadratic expression, the looper model of the interstand tension controller in the fourth embodiment is expressed by a linear expression. Since the filter includes the looper model Gθ (s), the order of the filter is lowered.

Figure 14:
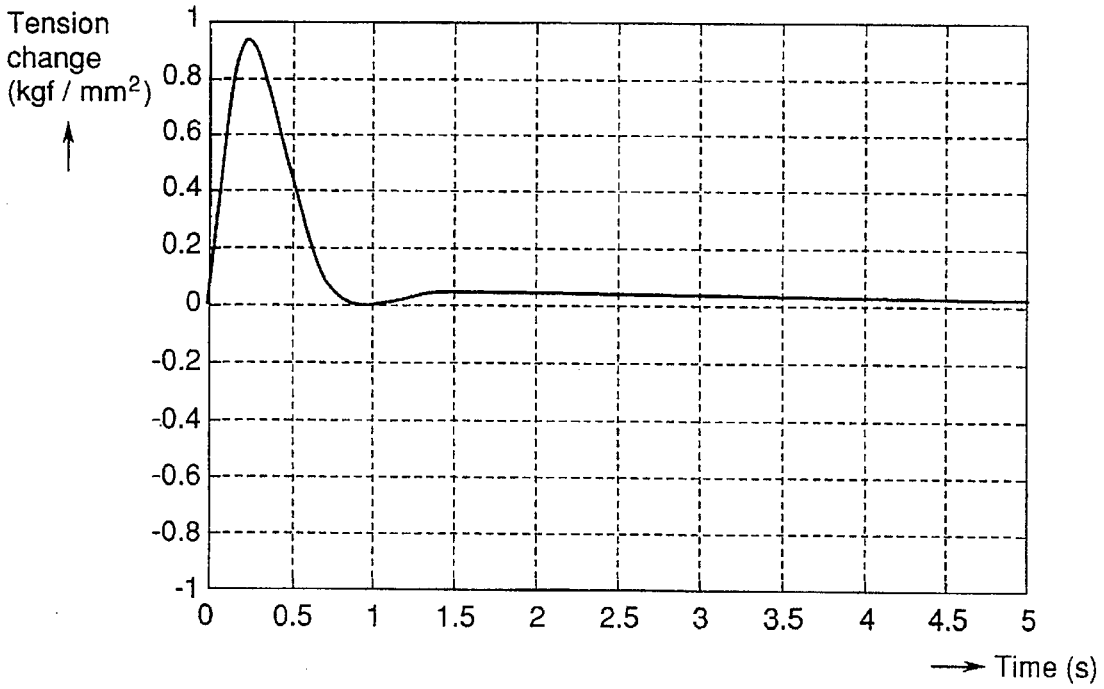
FIG.14 PRIOR ART
FIG. 14 is a graph showing the tension regulating effect of a conventional noninteractive interstand tension controller.
Figure 15:
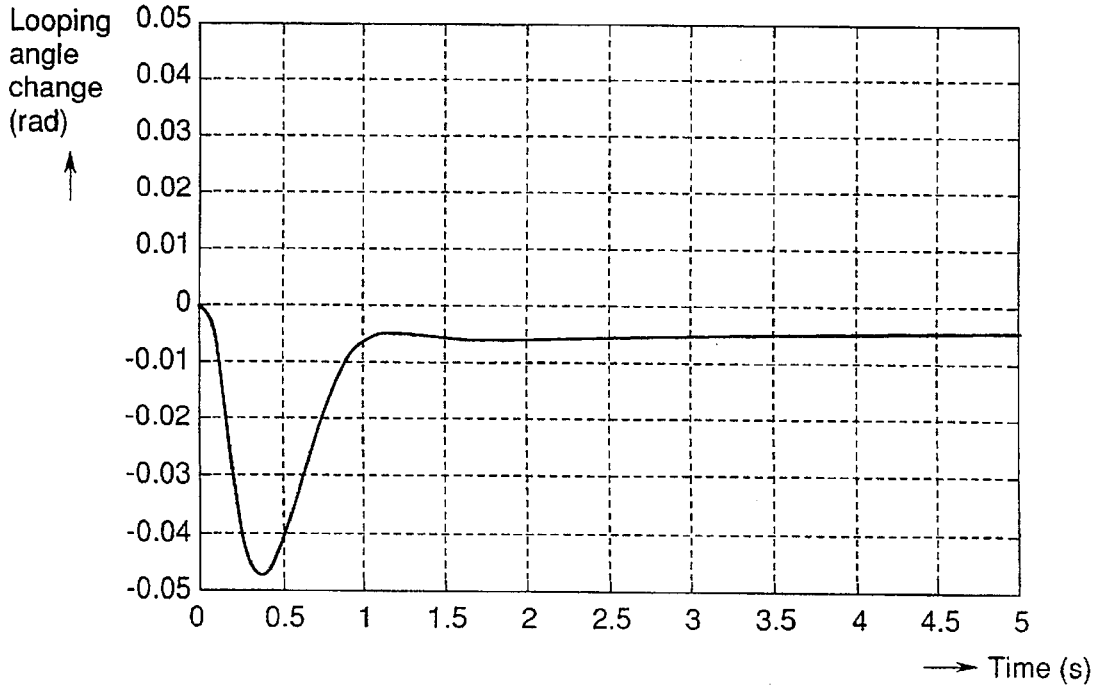
FIG.15 PRIOR ART
FIG. 15 is a graph showing the looping angle regulating effect of the conventional noninteractive interstand tension controller.
Figure 16:
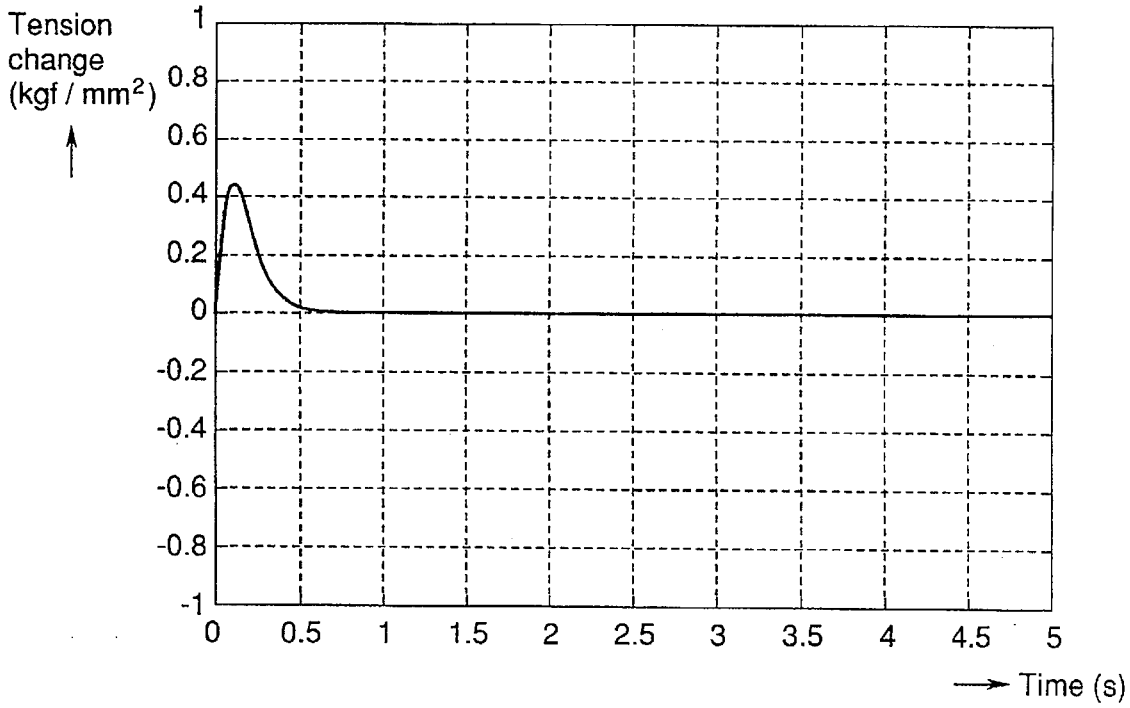
FIG. 16 is a graph showing the tension regulating effects of the interstand tension controllers in the first to the fourth embodiment of the present invention.
Figure 17:
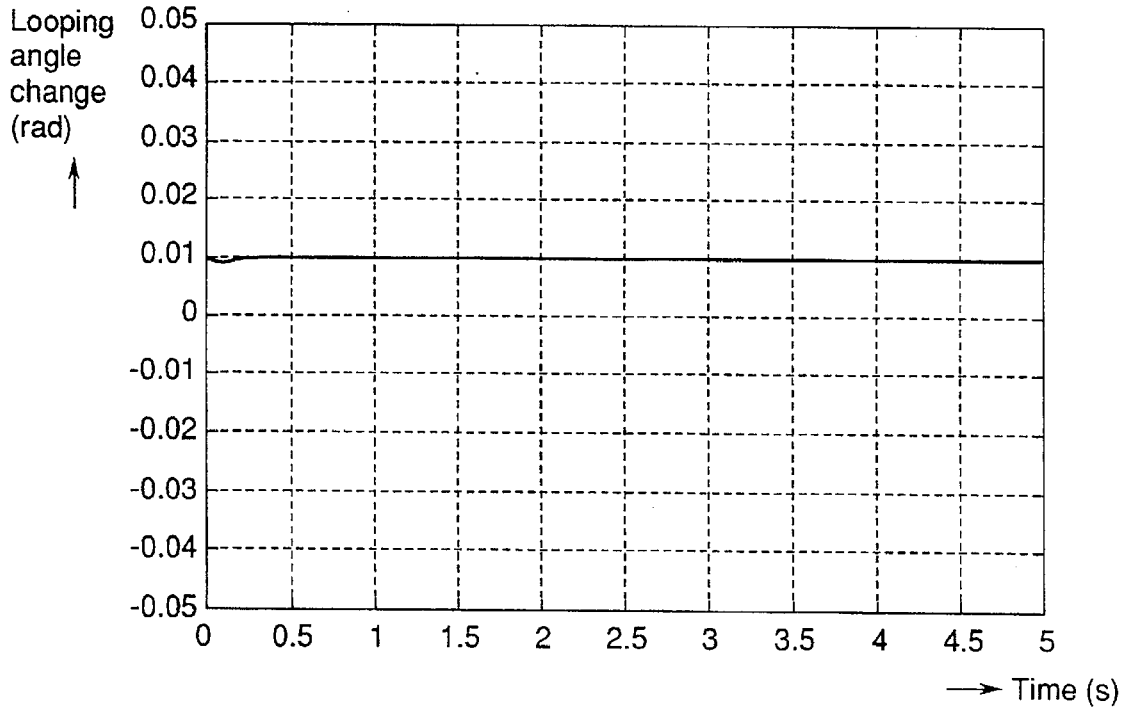
FIG. 17 is a graph showing the looping angle regulating effects of the interstand tension controllers in the first to the fourth embodiment of the present invention.

FIGS. 14 to 17 show the effects of the interstand tension controllers in the first to the fourth embodiment confirmed through simulation, in which a change in the rolling speed resulting from a 10 μm change in draft was applied to the interstand tension controllers. As is obvious from FIGS. 14 and 15 showing the control performance of the conventional noninteractive interstand tension controller, both the interstand tension (FIG. 14) and the looping angle (FIG. 15) varied greatly and it took a comparatively long time to restore a steady state. On the other hand, as is obvious from FIGS. 16 and 17 showing the control performance of the interstand tension controllers of the present invention, the interstand tension controllers of the present invention limited the variation of the interstand tension (FIG. 16) and that of the looping angle (FIG. 17) to a very low degree.

Fifth Embodiment

Figure 18:
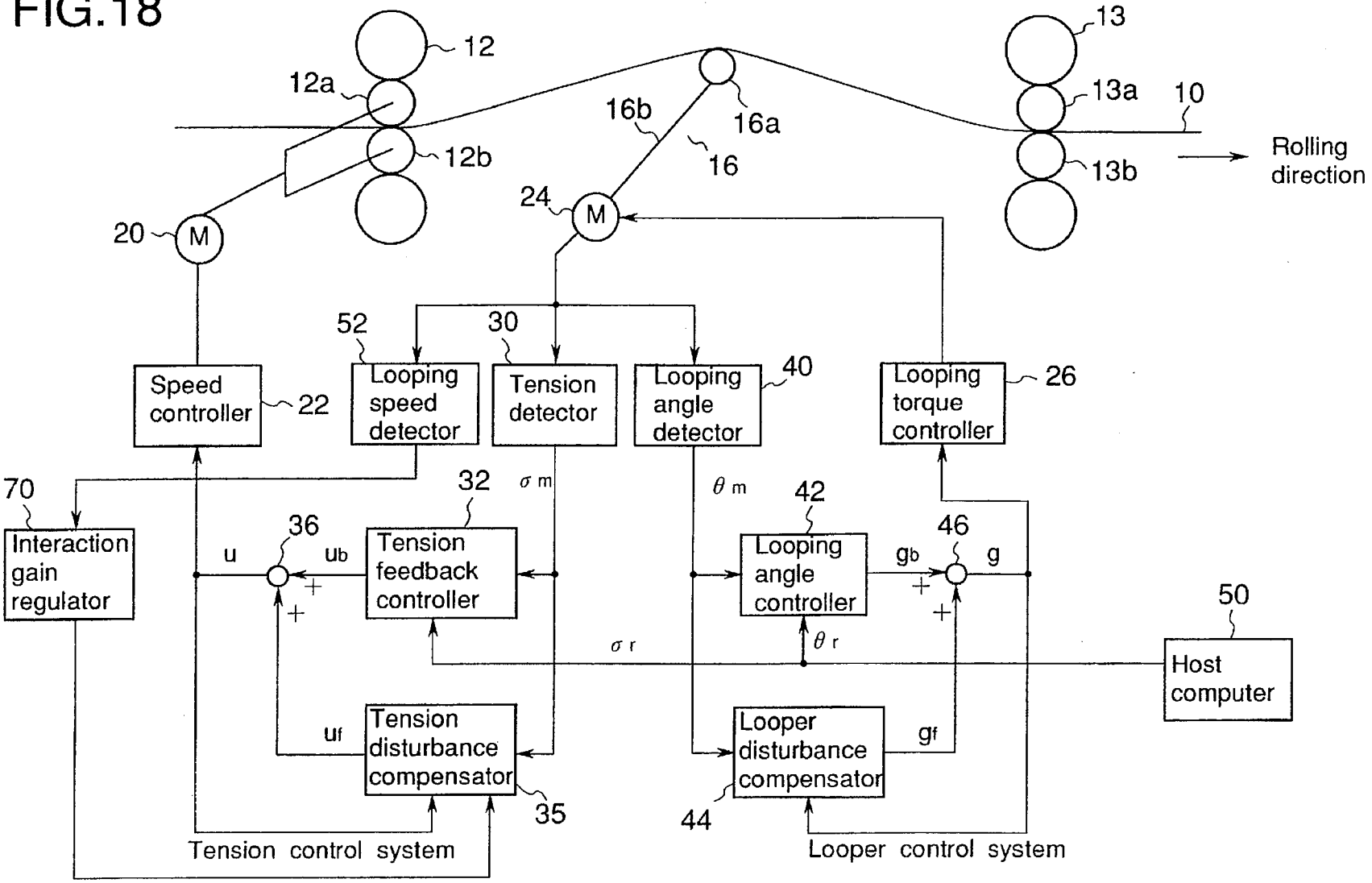
FIG. 18 is a block diagram of an interstand tension controller in a fifth embodiment according to a third aspect of the present invention.

Referring to FIG. 18, the output of a looping speed detector 52 is transferred through an interaction gain regulator 70 to a tension disturbance compensator 35 and is applied to the tension model of the tension disturbance compensator 35. Part of the looping speed signal to be applied to the tension disturbance compensator 35 can be adjusted by the interaction gain regulator 70 and is neither estimated nor offset.

Sixth Embodiment

Figure 19:
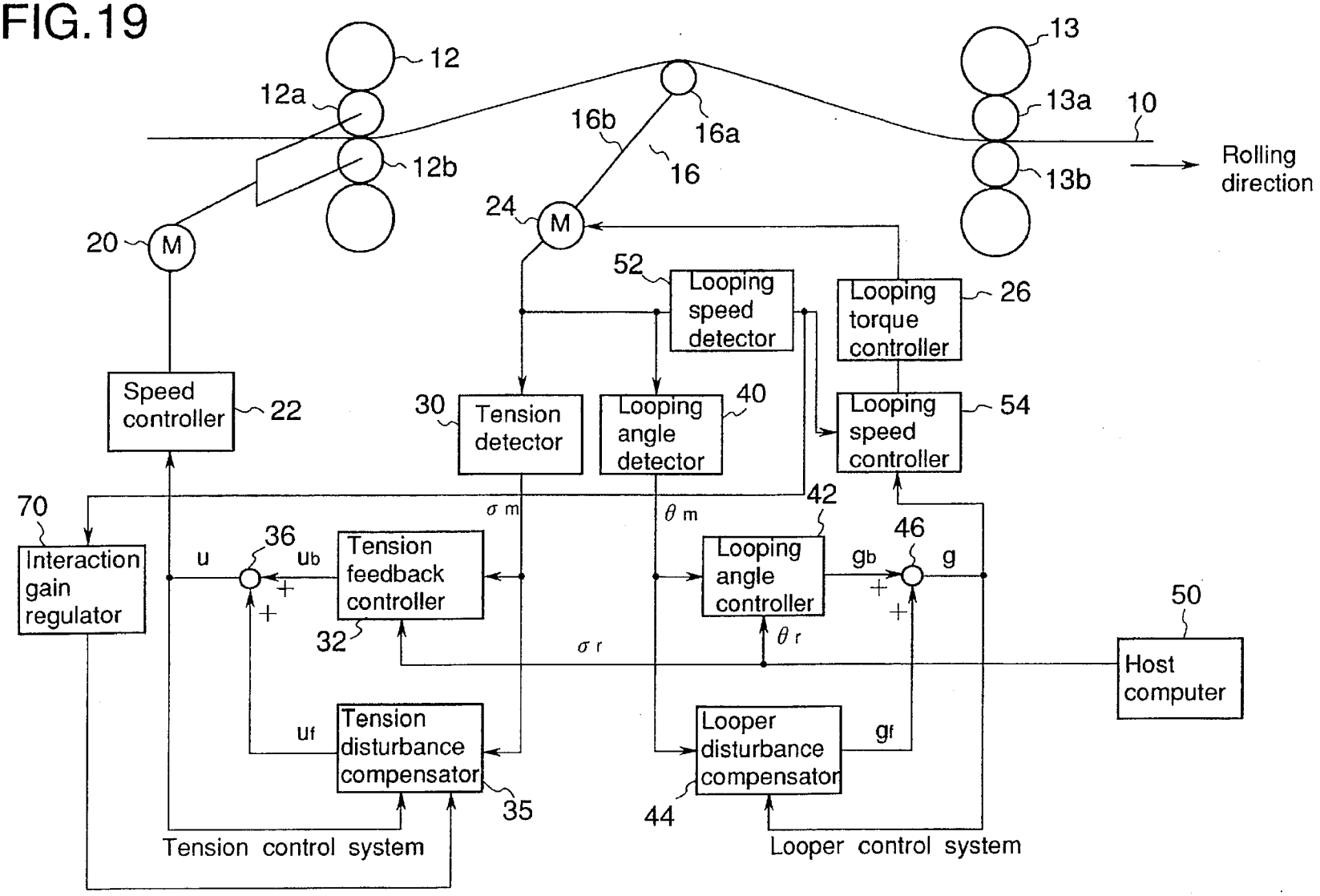
FIG. 19 is a block diagram of an interstand tension controller in a sixth embodiment according to the third aspect of the present invention.

While the looping angle is regulated by controlling the looping torque by a looping torque controller 26 in the fifth embodiment, an interstand tension controller in a sixth embodiment according to the present invention shown in FIG. 19 a looping speed detector 52 detects the looping speed and feeds back the detected looping speed to a looping speed controller 54. The looping speed detector 52 and the looping speed controller 54 constitute a looping speed control loop.

Figure 20:
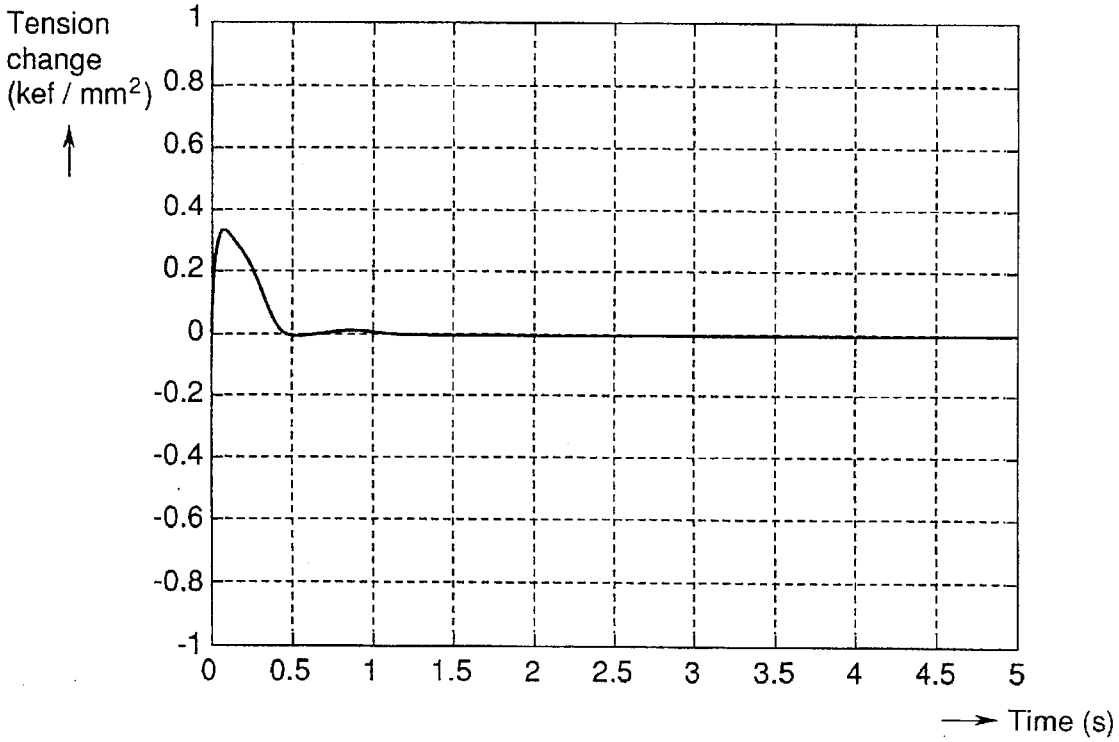
FIG. 20 is a graph showing the tension regulating effects of the interstand tension controller in the fifth and sixth embodiment of the present invention.
Figure 21:
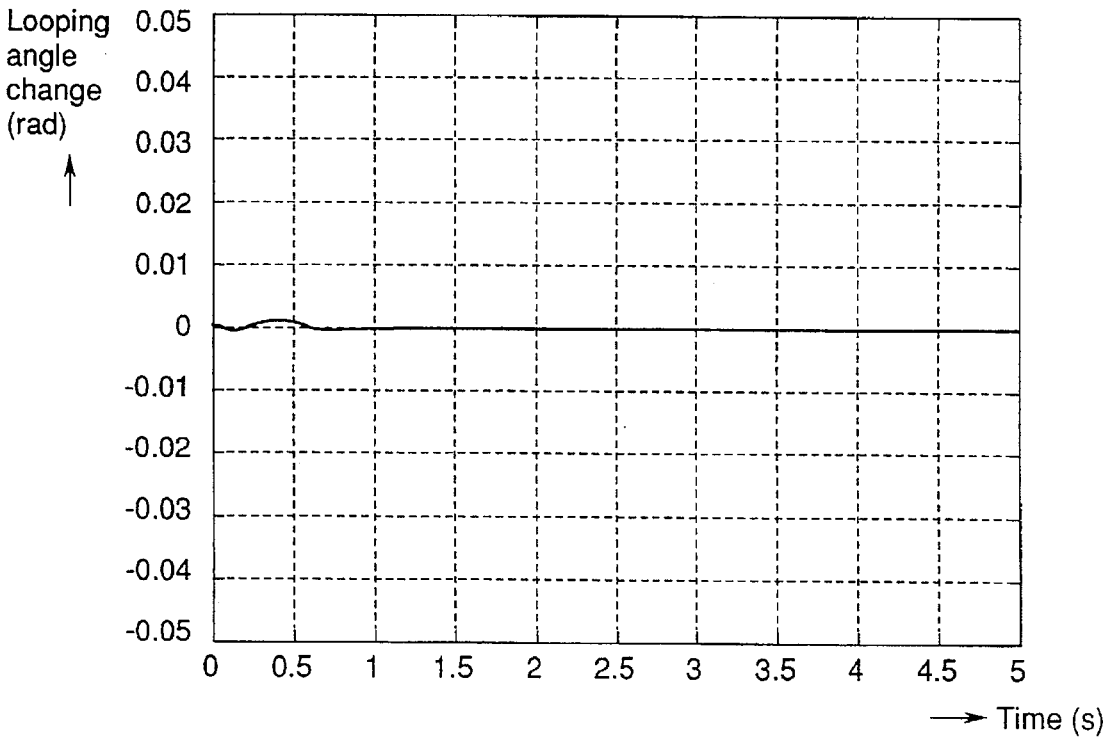
FIG. 21 is a graph showing the looping angle regulating effects of the interstand tension controller in the fifth and sixth embodiment of the present invention.

FIGS. 20 and 21 shows the effects of the interstand tension controllers in the fifth and the sixth embodiments of the present invention confirmed through simulation, in which a change in rolling speed resulting from a 10 μm change in draft was applied to the interstand tension controllers. As is obvious from the comparative observation of FIGS. 14 and 15 showing the effect of a conventional noninteractive interstand tension controller and FIGS. 20 and 21 showing the effect of the interstand tension controllers in the fifth and the sixth embodiments of the present invention, both the interstand tension and the looping angle varied greatly when the interstand tension was controlled by the conventional interstand tension controller, while the variation of the interstand tension and that of the looping angle were limited to a very low degree when the interstand tension was controlled by the interstand tension controllers in the fifth and the sixth embodiments of the present invention. It is known from the comparative observation of FIGS. 16 and 17 showing the simulated control performance of the interstand tension controllers in the first to the fourth embodiments of the present invention and FIGS. 20 and 21 showing the simulated control performance of the interstand tension controllers in the fifth and the sixth embodiments of the present invention that the tension variation suppressing effect of the latter (fifth and sixth embodiments) interstand tension controllers is slightly higher than that of the former (first to fourth embodiments) interstand tension controllers, and the looping angle variation suppressing effect of the latter interstand tension controllers is slightly lower than that of the former interstand tension controllers. However, the degree of variation of the looping angle when the looping angle is controlled by the latter interstand tension controllers is low enough to secure stable travel of the workpiece and will not cause any practical problems at all. The results of simulation of the control operation of the interstand tension controllers in the fifth and the sixth embodiments that allow moderate interaction between the interstand tension and the looping angle proved that the looper absorbed the tension variation.

Seventh Embodiment

Figure 22:
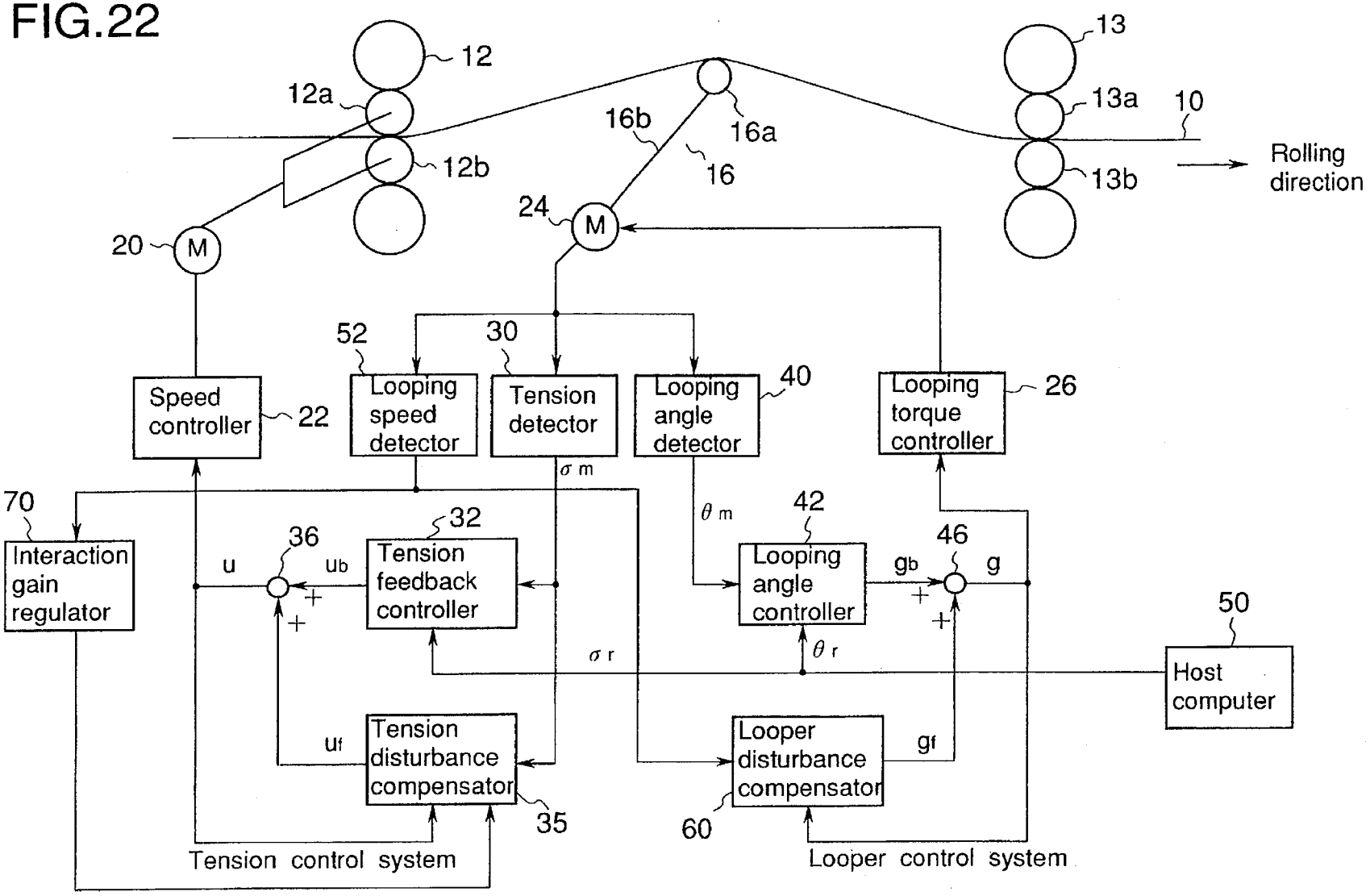

A seventh embodiment in accordance with the fourth aspect of the present invention, similar to the third embodiment, can be constructed in a configuration shown in FIG. 22.

Results of the simulated control operation of the interstand tension controller in the seventh embodiment of the present invention were entirely the same as those of the interstand tension controller in the fifth and the sixth embodiments.

EighthEmbodiment

An eighth embodiment in accordance with the fifth aspect of the present invention will be described in detail.

Figure 23:
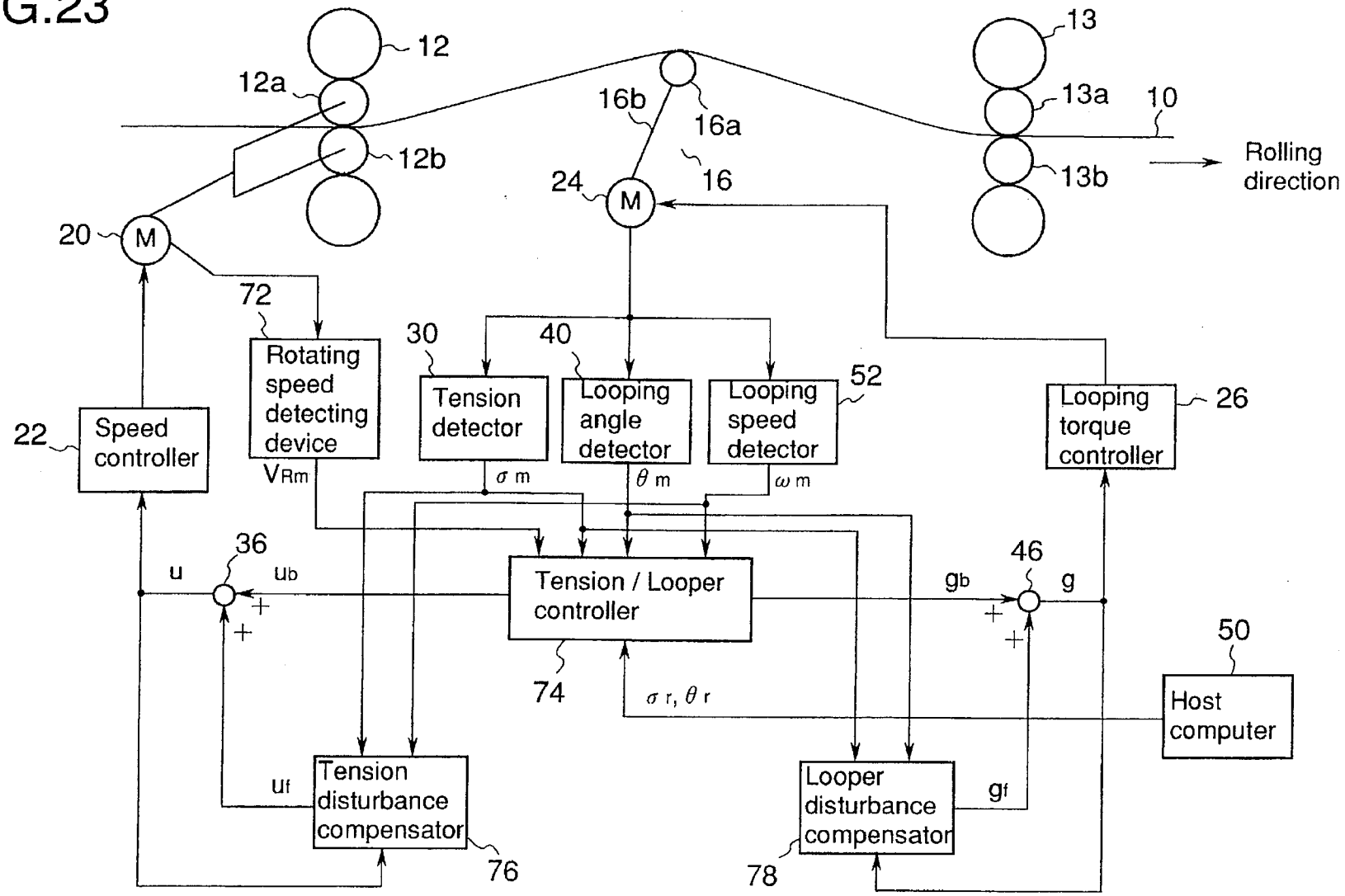
FIG. 23 is a block diagram of an interstand tension controller in an eighth embodiment according to a fifth aspect of the present invention.

In the eighth embodiment shown in FIG. 23, a tension/looper controller 74 receives a measured tension σm provided by a tension detector 30, the deviation of the measured tension σm from a desired tension σr given by a host computer 50, a measured looping angle θm measured by a looping angle detector 40, the deviation of the measured looping angle θm from a desired looping angle σr given by the host computer 50, a measured looping speed ωm measured by a looping speed detector 52 and a measured rotating speed VRm measured by a rotating speed detector 72, and calculates a looping torque command gb and a rotating speed command ub to make the actual tension coincide with the desired tension θr and the actual looping angle coincide with the desired looping angle θr.

A tension disturbance compensator 76 in accordance with the present invention, similar to that employed in the first embodiment, includes a model, estimates a disturbance acting on the tension/looper controller 74 on the basis of the difference between an estimated tension provided by the model and the measured tension σm measured by the tension detector 30 and calculates a rotating speed correction uf to offset the disturbance. This embodiment differs from the first embodiment in that the tension disturbance compensator 76 need not offset tension variation due to the interference by the looper because the interference between the tension and the looping angle is controlled by the tension/looper controller 74. The measured looping speed ωm measured by the looping speed detector 52 is added to inputs to the model so that the rotating speed correction uf does not include any component to offset tension variation due to the interference by the looper.

The looper disturbance compensator 78, similar to that of the first embodiments, includes a model, estimates a disturbance acting on the tension/looper controller 74 on the basis of the difference between the estimated looping angle provided by the model and the measured tension θm provided by the looping angle detector 40, and calculates a looping torque correction gf to offset the disturbance. This embodiment differs from the first embodiment in that the looper disturbance compensator 78 need not offset looping angle variation due to the interference by the tension because the tension/looper controller 74 controls the interference between tension and looping angle. The measured tension σm measured by the tension detector 30 is added to inputs to the model so that the looping torque correction gf does not include any component to offset looping angle variation due to the interference by the tension.

Ninth Embodiment

Figure 24:
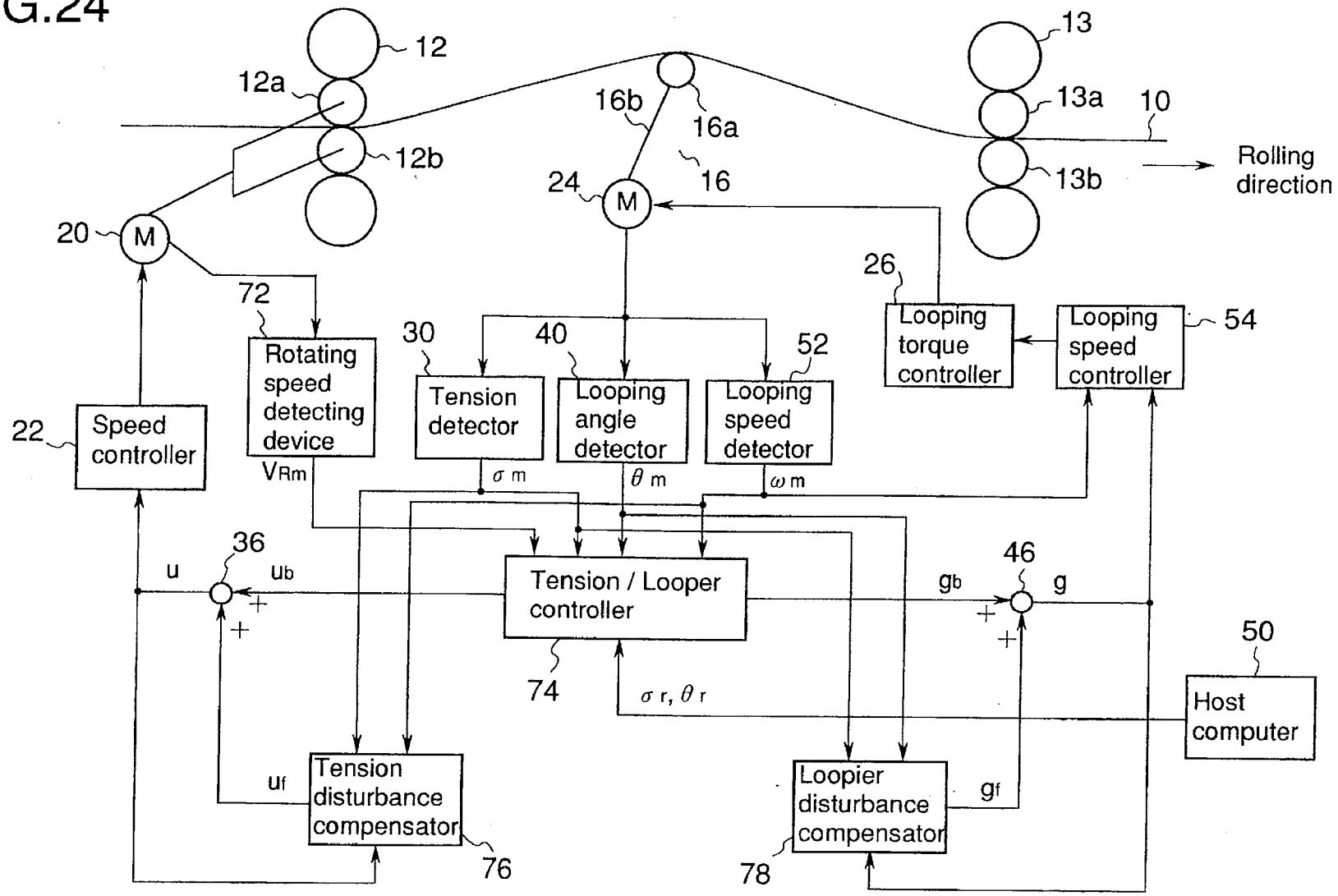
FIG. 24 is a block diagram of an interstand tension controller in a ninth embodiment according to the fifth aspect of the present invention.

Although the looping torque controller 26 of the eighth embodiment controls the looping angle by regulating the looping torque, in a ninth embodiment, a looping speed control loop including a looping speed controller 54 as shown in FIG. 24 may be employed. The models included in the disturbance compensators employed in the ninth embodiment may use expressions (2) and (3) like the second embodiment.

Tenth and Eleventh Embodiments

Figure 25:
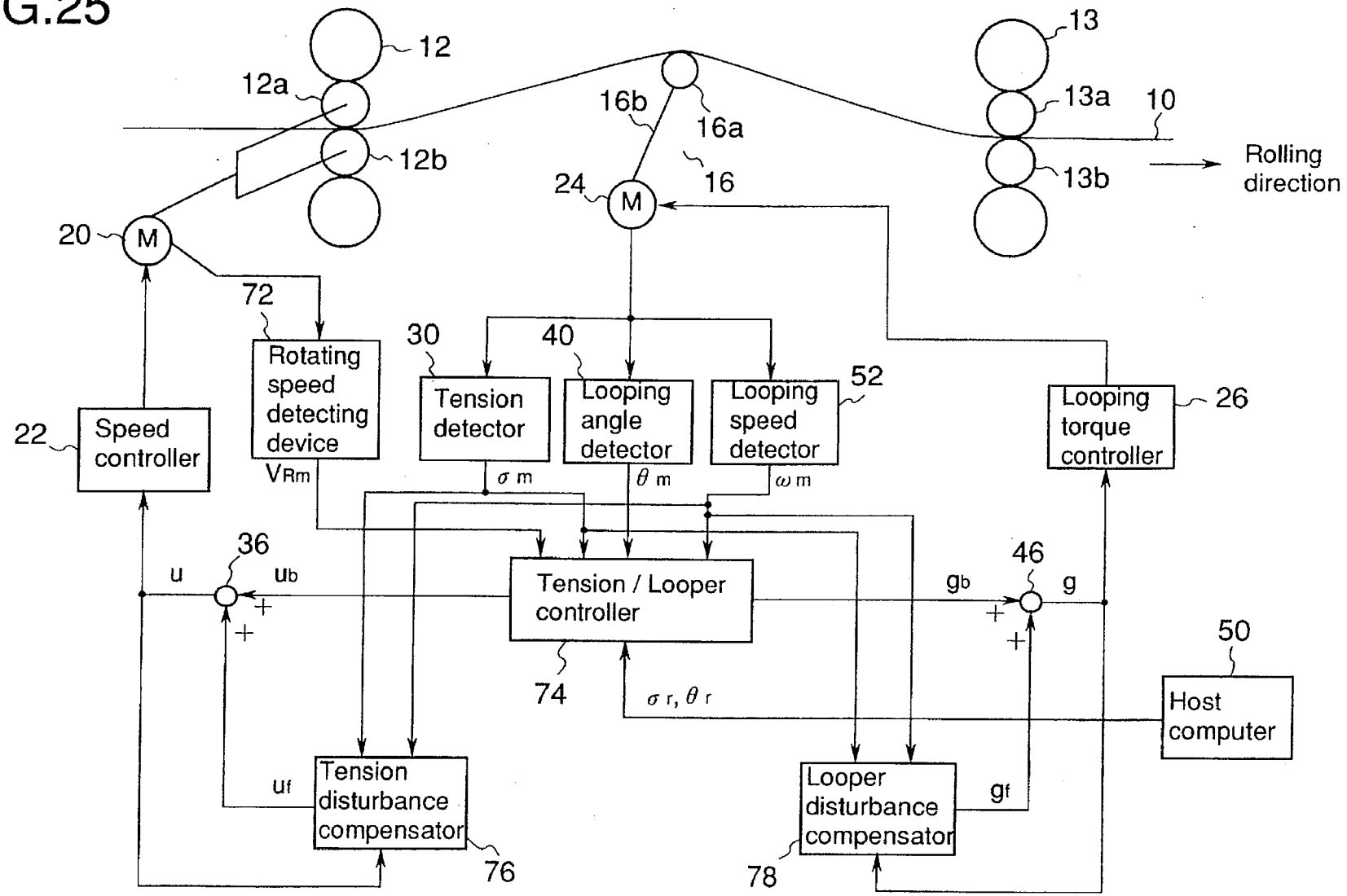
FIG. 25 is a block diagram of an interstand tension controller in a tenth embodiment according to a sixth aspect of the present invention.
Figure 26:
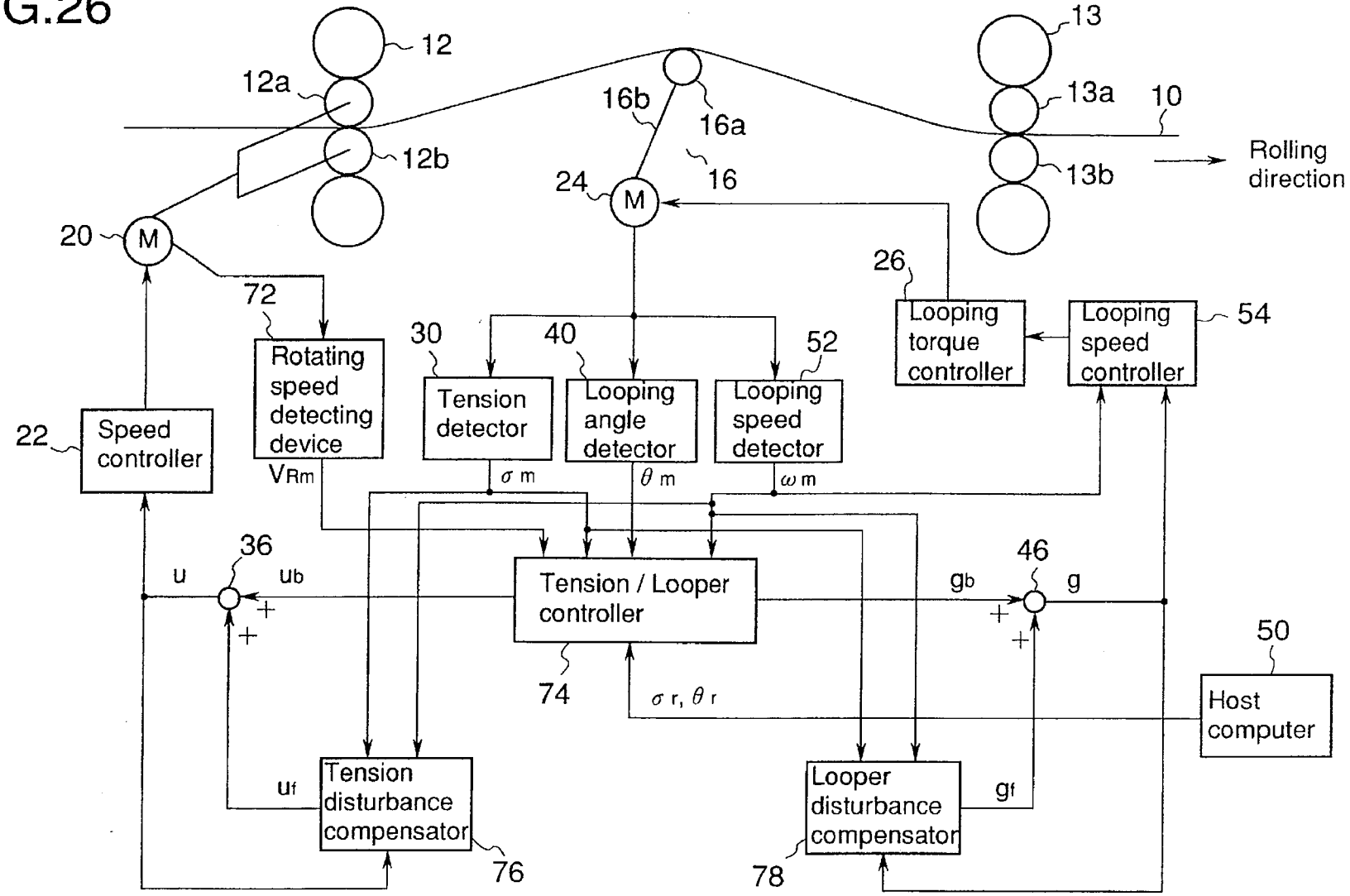
FIG. 26 is a block diagram of an interstand tension control system in an eleventh embodiment according to the sixth aspect of the present invention.

Tenth and eleventh embodiments in accordance with the sixth aspect of the present invention, similar to the third and the fourth embodiments, may have a configuration as shown in FIGS. 25 and 26. Here, 79 is a looper disturbance compensator of these embodiments.

Figure 27:
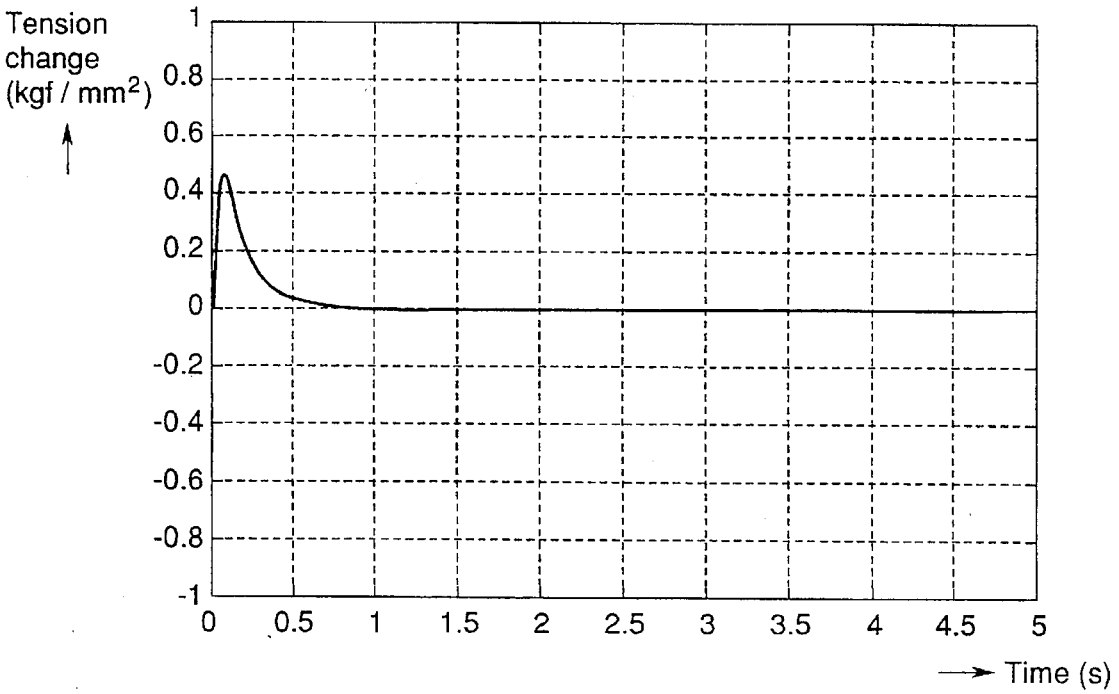
FIG. 27 is a graph showing the tension regulating effects of the interstand tension controllers in the tenth embodiments of the present invention.
Figure 28:
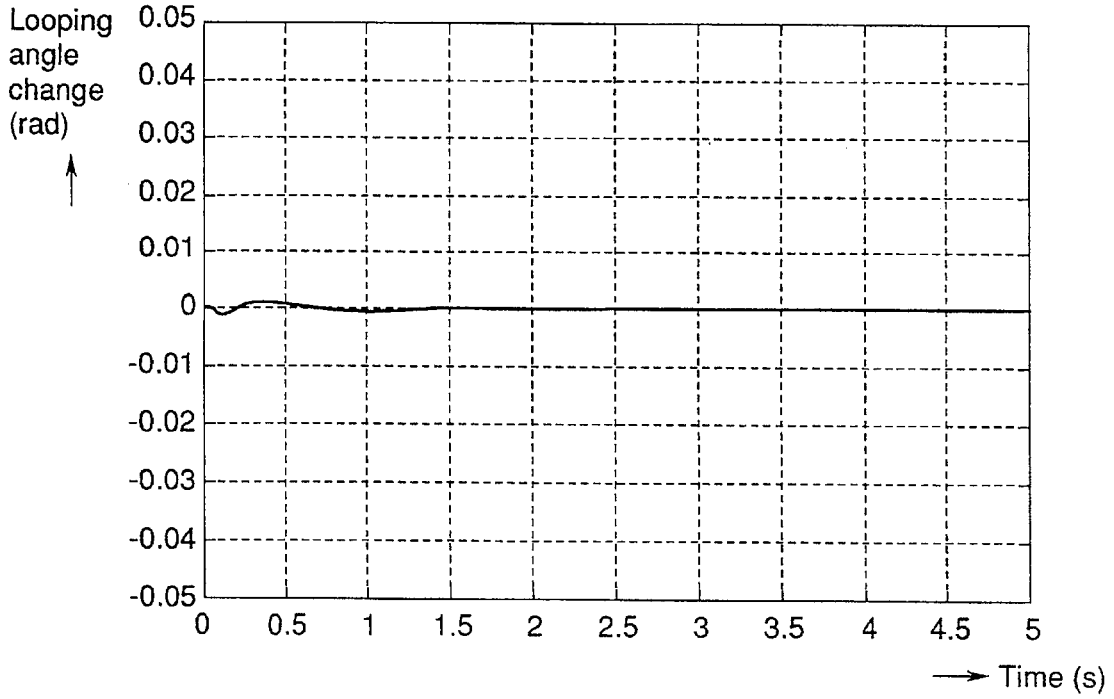
FIG. 28 is a graph showing the looping angle regulating effects of the interstand tension controllers in the tenth and the eleventh embodiments of the present invention.

FIGS. 27 and 28 are graphs showing the tension and looping angle regulating effects of the interstand tension controllers in the tenth and eleventh embodiments.

The control performance of the conventional interstand tension controller provided with two feedback loops to regulate the interstand tension by controlling the looping torque or the looping speed and to regulate the looping angle by controlling the rotating speed of the rolls of the rolling stand can be enhanced by incorporating two disturbance compensators respectively into the two feedback loops. However, since the interstand tension and the looping angle are controlled indirectly through the term of interaction between tension and looping angle, the order of the controlled systems and that of the models increase and hence the interstand tension controller has a complicated configuration, which is undesirable.

In the interstand tension controllers in the first to the seventh embodiments, the tension disturbance compensator 34 and the looper disturbance compensator 44 or 60 may be substituted by a single disturbance compensator provided with a model including a term representing interaction between the tension and the looping angle. In such a case, however, the output of the disturbance compensator does not include any component to compensate for the interaction. Therefore, the interstand tension controller must be provided with a part corresponding to a precompensator in addition to the tension feedback controller 32 and the tension controller 42, which complicates the configuration of the interstand tension controller. If precompensation is omitted, it is more effective for the enhancement of the control performance of the interstand tension controller to employ models not including any term of interaction, such as those employed in the foregoing embodiments of the present invention, and to compensate for interactions as disturbances by the disturbance compensator.

Figure 29:
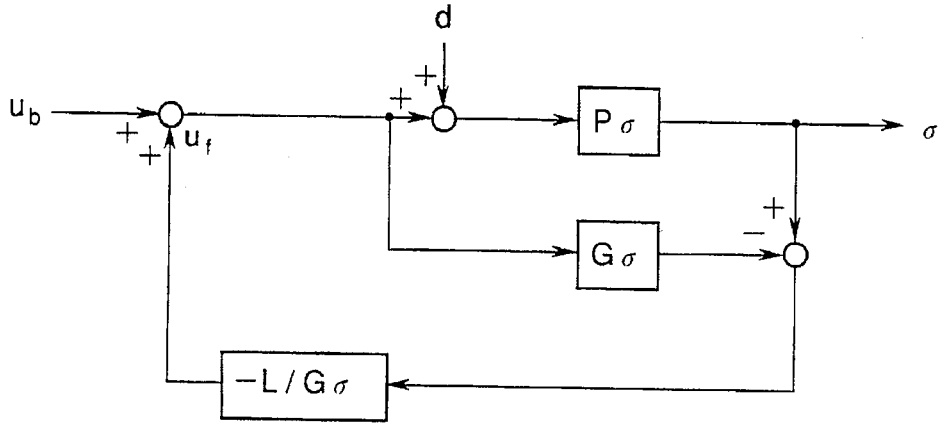
FIG. 29 is a block diagram of assistance in explaining a tension control system included in the interstand tension controllers in the first to the eleventh embodiment.
Figure 30:
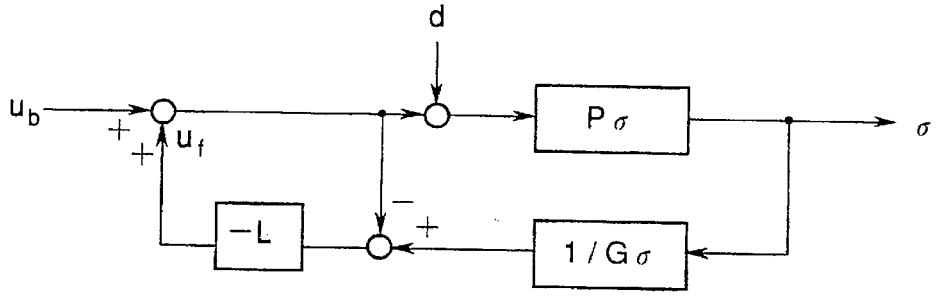
FIG. 30 is a block diagram of assistance in explaining a modification of the tension control system explained with reference to FIG. 29.
Figure 31:
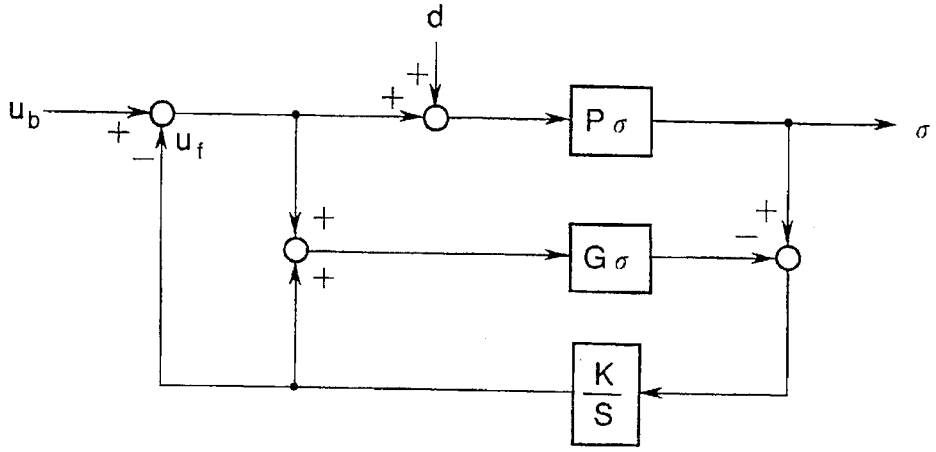
FIG. 31 is a block diagram of assistance in explaining another modification of the tension control system explained with reference to FIG. 29.

The foregoing embodiments are provided with the tension model and the looper model and determine disturbance compensating signals on the basis of the difference between the output of the tension model and a measured interstand tension and the difference between the output of the looper model and a measured looping angle by passing through the filters, respectively. In the tension model, the filter has a configuration represented by expression (7) including an inverse model $1/G\sigma$ as shown in FIG. 29, and the difference between the outputs of a plant $P\sigma$ and the model $G\sigma$ is applied to the inverse model $1/G\sigma$. The output of the model $P\sigma$ may be applied directly to the inverse model $G\sigma$ as shown in FIG. 30. It is also possible to integrate the difference between the output of the plant $P\sigma$ and that of the model $G\sigma$ to feed back a value obtained by multiplying the integration by a gain K to the model $G\sigma$ and to use the feedback signal as a disturbance compensating signal as shown in FIG. 31. In this case, the sign of the disturbance compensating signal is inverted. The configurations shown in FIGS. 29 to 31 may optionally be modified, provided that modified configurations are equivalent to those shown in FIGS. 29 to 31.

Twelfth Embodiment

Figure 32:
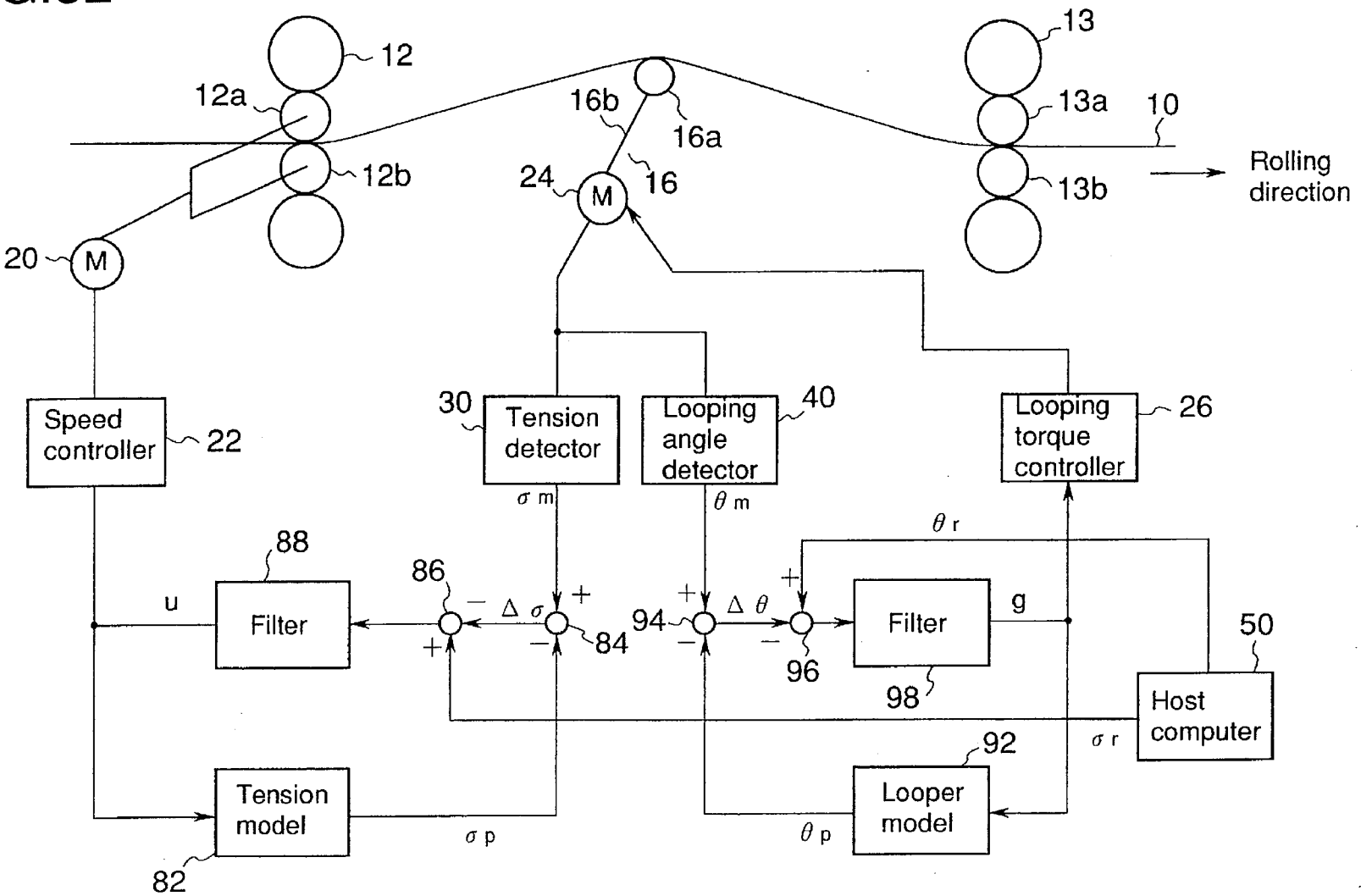
FIG. 32 is a block diagram of an interstand tension controller in a twelfth embodiment according to a seventh aspect of the present invention.

FIG. 32 shows an interstand tension controller as applied to a hot rolling mill having a plurality of rolling stands and provided with a looper between the adjacent rolling stands.

In a tension control system included in the interstand tension controller, a tension detector 30 receives a signal representing a reaction force of a workpiece 10 acting on the looper 16 from a load cell, not shown, installed in the looper 16 and calculates a measured interstand tension $\sigma m$ of the workpiece 10, a tension model 82 calculates an estimated tension $\sigma p$ on the basis of a rotating speed command u given to a roll speed controller 22, a subtracter tension $\Delta\sigma$ and a measured interstand tension $\sigma m$ provided by the tension detector 30, a subtracter 86 subtracts the difference $\Delta\sigma$ from a desired tension $\sigma r$ provided by a host computer 50, and gives a signal representing the result of subtraction to a filter 88, and the filter 88 calculates a rotating speed command u to offset disturbance included in the input signal.

In a looper control system included in the interstand tension controller, a looping angle detector 40 detects the looping angle and provides a measured looping angle $\theta m$, a looper model 92 estimates an estimated looping angle $\theta p$ on the basis of a looping torque command g given to a looping torque controller 26, a subtracter 94 calculates the difference $\Delta\theta$ between the estimated looping angle $\theta p$ and the measured looping angle $\theta m$ provided by the looping angle detector 40, a subtracter 96 subtracts the difference $\Delta\theta$ from a desired looping angle $\theta r$ provided by a host computer 50 and gives a signal representing the result of subtraction to a filter 98, and the filter 98 calculates a looping torque command g necessary for offsetting a disturbance.

Thirteenth Embodiment

Figure 33:
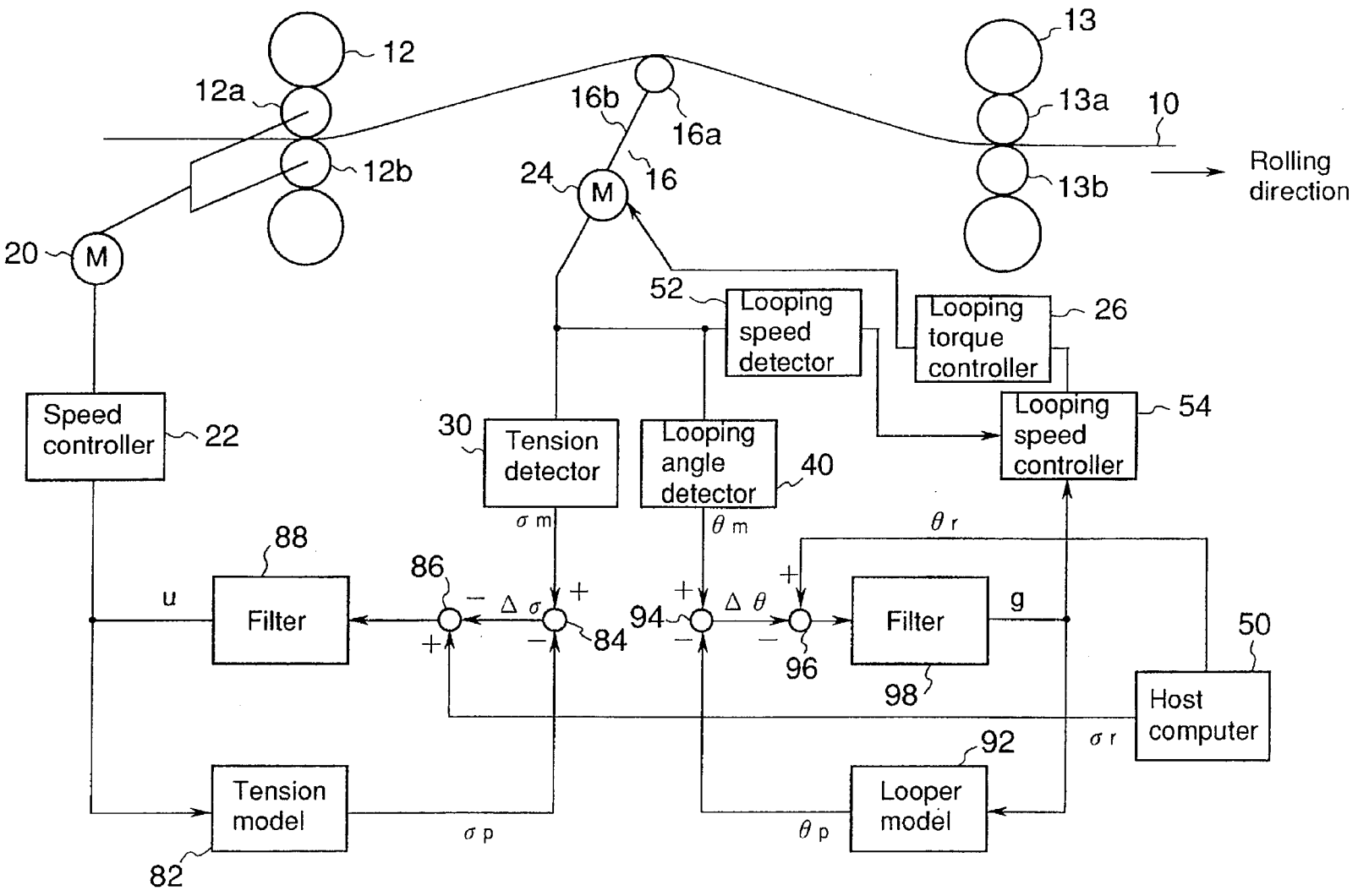
FIG. 33 is a block diagram of an interstand tension controller in a thirteenth embodiment according to the seventh aspect of the present invention.

The interstand tension controller regulates the looping angle by controlling the looping torque by the looping torque controller 26. In an interstand tension controller in a thirteenth embodiment according to the present invention shown in FIG. 33 is provided with a looping speed control loop including a looping speed detector 52 to feed back a detected looping speed to a looping speed controller 54. Models 82 and 92 and filters 88 and 98 included in the interstand tension controller in the thirteenth embodiment will be described in detail.

The characteristics of the interstand tension of a workpiece on a hot rolling mill and the looper of the hot rolling mill, a tension model (expression (2)), and a looper model (expression (3)) are the same as those of the second embodiment. The difference $\Delta\sigma$ between the output of the model 82 and a measured interstand tension is expressed by expression (4). The characteristics $F\sigma$ of the filter 88 is expressed by:

$$F\sigma=-1/P\sigma \tag{9}$$

and the output u of the filter 88 corresponding to the difference $\Delta\sigma$ is expressed by:

$$u=-d \tag{10}$$

where d is a disturbance. Accordingly, when the rotating speed is regulated according to the output u of the filter 88, the disturbance can completely be offset. However, a transfer function representing the relation between a desired interstand tension $\sigma r$ and the interstand tension is "1," the disturbance cannot completely be offset. Therefore, the filter 88 must have characteristics $F\sigma$ expressed by:

$$F\sigma=-L/P\sigma \tag{11}$$

where L is the characteristics of a low-pass filter on which the disturbance suppressing characteristics and the response characteristics of the tension system are dependent.

Similarly, the disturbance suppressing characteristics and the response characteristics of the looper system can be determined by the filter 98.

Fourteenth Embodiment

Figure 34:
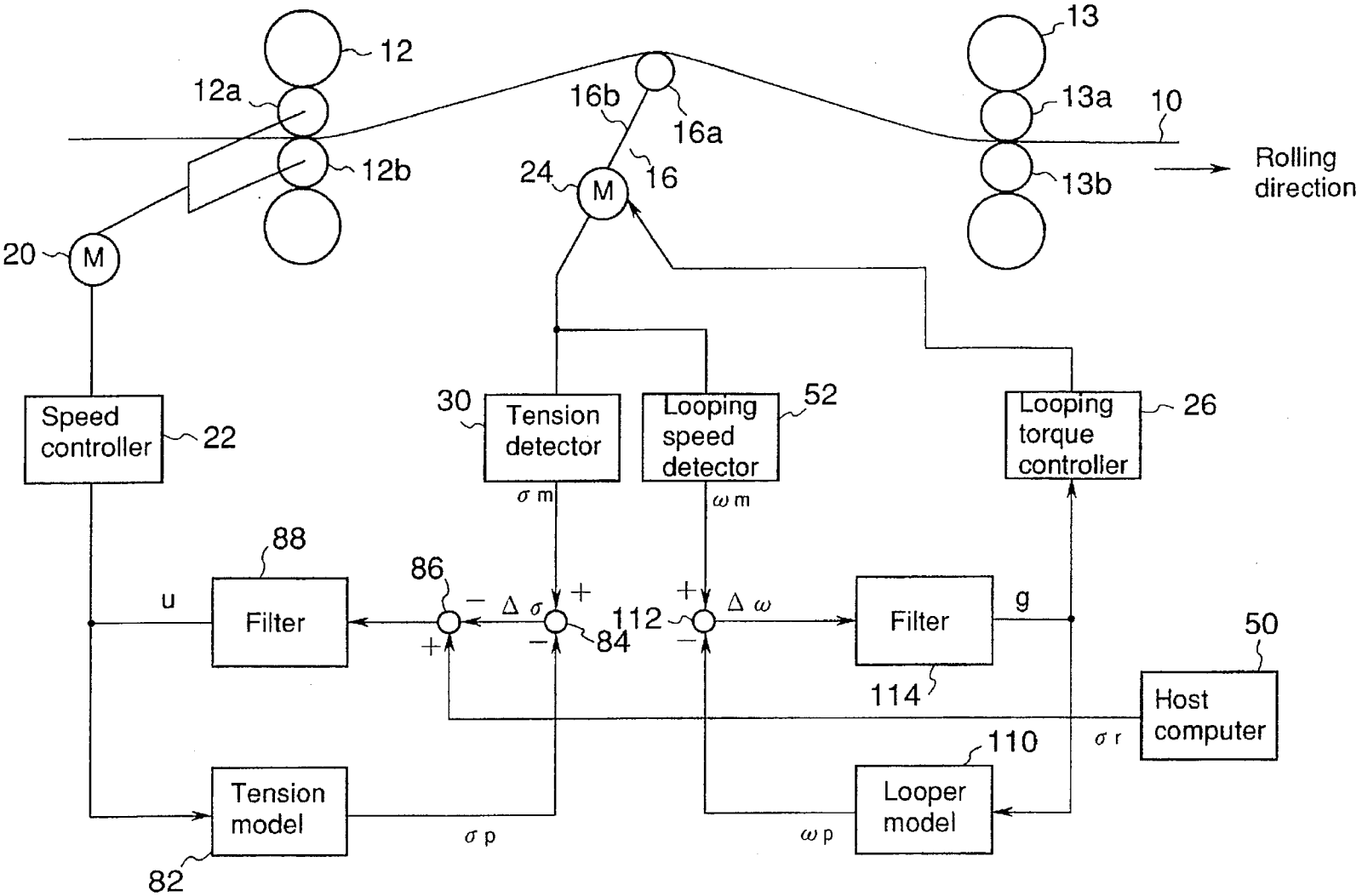
FIG. 34 is a block diagram of an interstand tension controller in a fourteenth embodiment according to an eighth aspect of the present invention as applied to hot rolling.

In an interstand tension controller in a fourteenth embodiment according to the eighth aspect of the present invention shown in FIG. 34, a looping speed detector 52 detects the looping speed, a looper model 110 estimates an estimated looping speed ωp on the basis of a looping torque command g given to a looping torque controller 26, a subtracter 112 calculates the difference Δω between the estimated looping speed ωp and a measured looping speed ωm provided by the looping speed detector 52 and gives the same to a filter 114, and the filter 114 calculates a looping torque command g necessary for offsetting a disturbance on the basis of the input signal.

Fifteenth Embodiment

Figure 35:
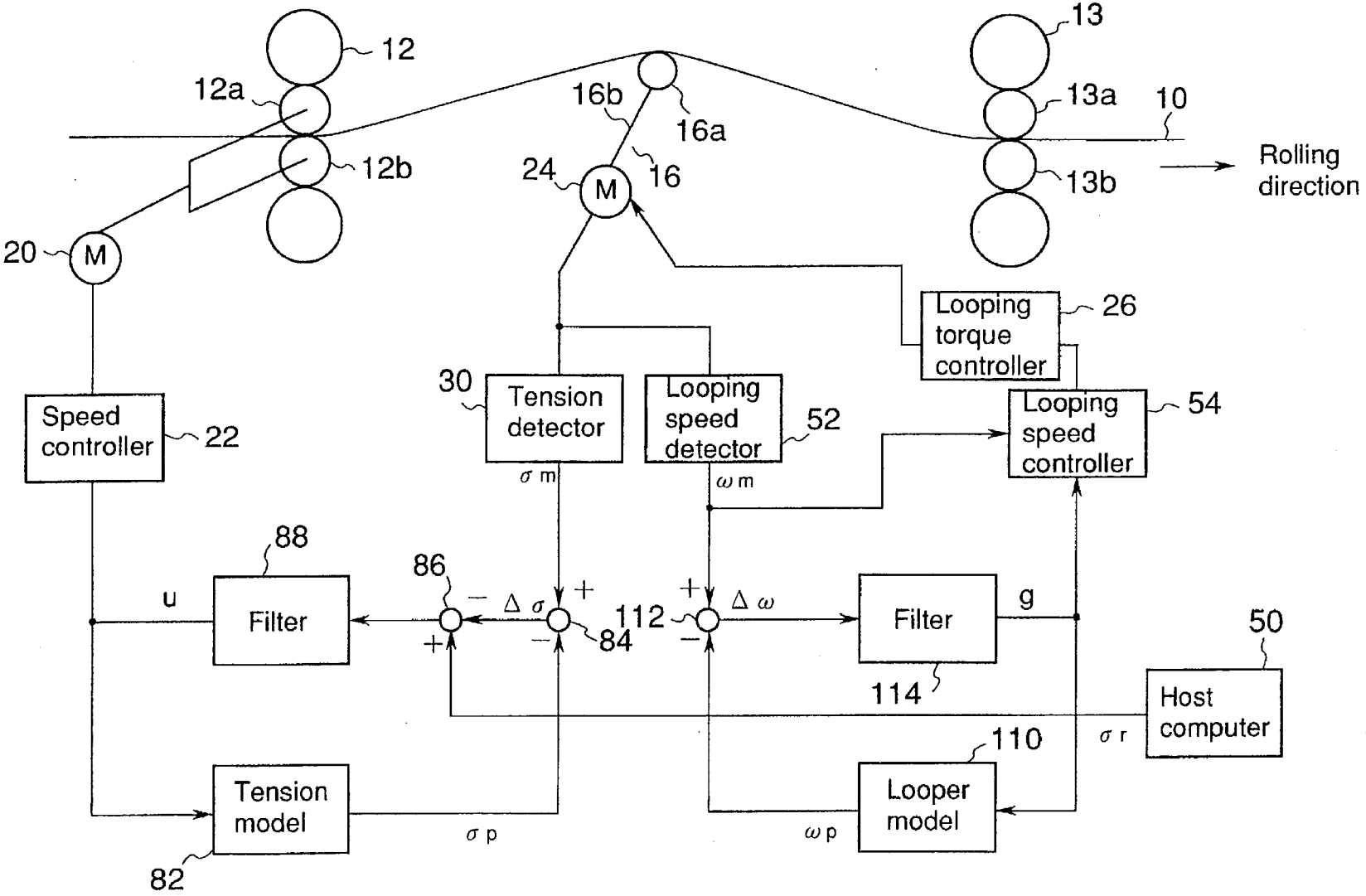
FIG. 35 is a block diagram of an interstand tension controller in a fifteenth embodiment according to the eighth aspect of the present invention.

The interstand tension controller in the fourteenth embodiment regulates the looping angle by controlling the looping torque by the looping torque controller 26. An interstand tension controller in a fifteenth embodiment according to the present invention shown in FIG. 35 is provided with a looping speed control loop including a looping speed detector 52 to feed back a detected looping speed to a looping speed controller 54. The interstand tension controller in the fifteenth embodiment is provided with a looper model which is the same as the looper model of the fourth embodiment represented by expression (8).

The tension control effects of the interstand tension controllers in the twelfth to the fifteenth embodiments confirmed through simulation were the same as those of the interstand tension controllers in the first to the fourth embodiments shown in FIGS. 16 and 17.

Sixteenth Embodiment

Figure 36:
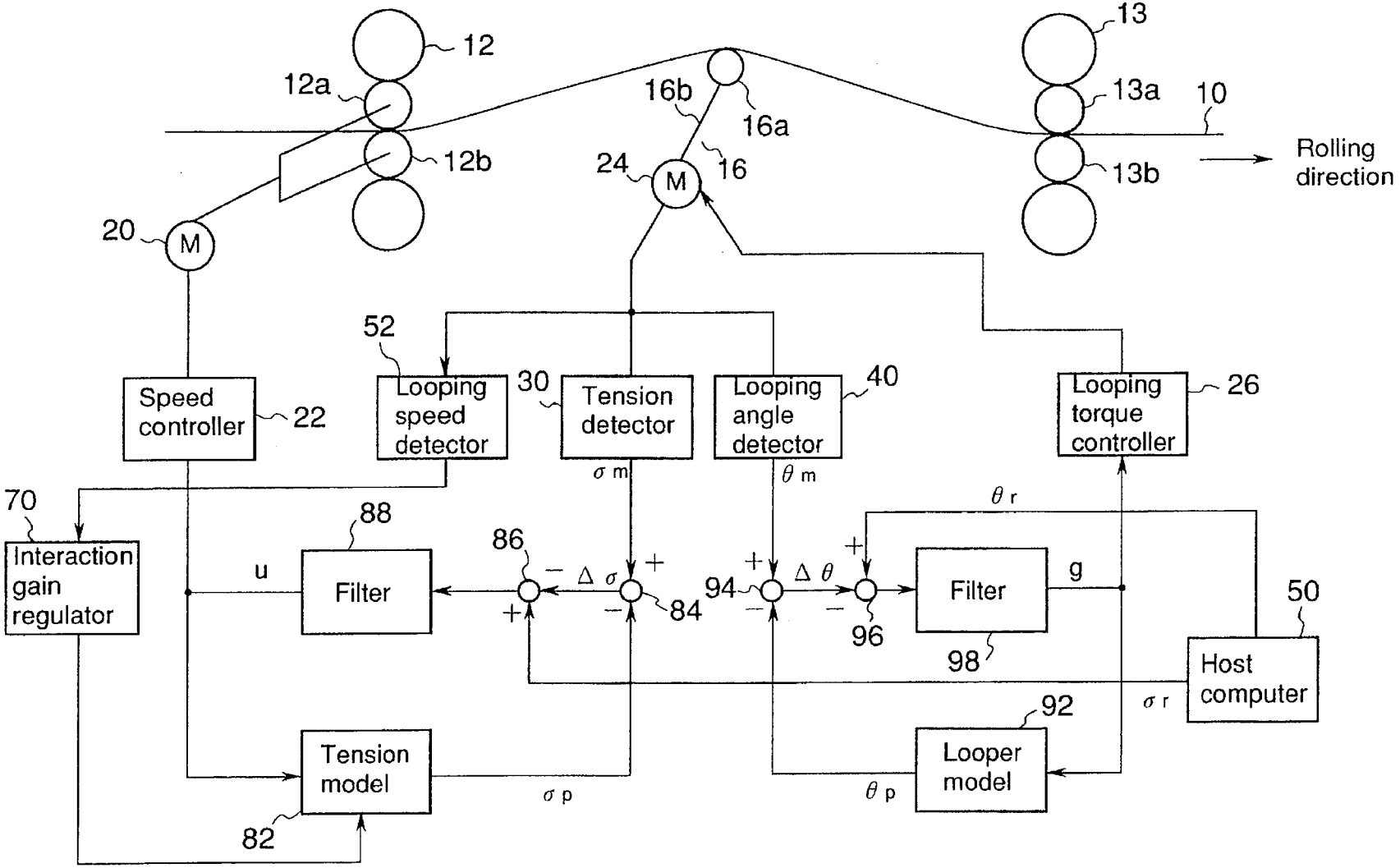
FIG. 36 is a block diagram of an interstand tension controller in a sixteenth embodiment according to a ninth aspect of the present invention as applied to hot rolling.

An interstand tension controller in a sixteenth embodiment according to the ninth aspect of the present invention shown in FIG. 36 transfers the output of a looping speed detector 52 through an interaction gain regulator 70 to a tension model 82. Part of the signal representing a looping speed to be given to the tension model 82 can be controlled by the interaction gain regulator 70 and the same is not estimated and not offset as a disturbance.

Seventeenth Embodiment

Figure 37:
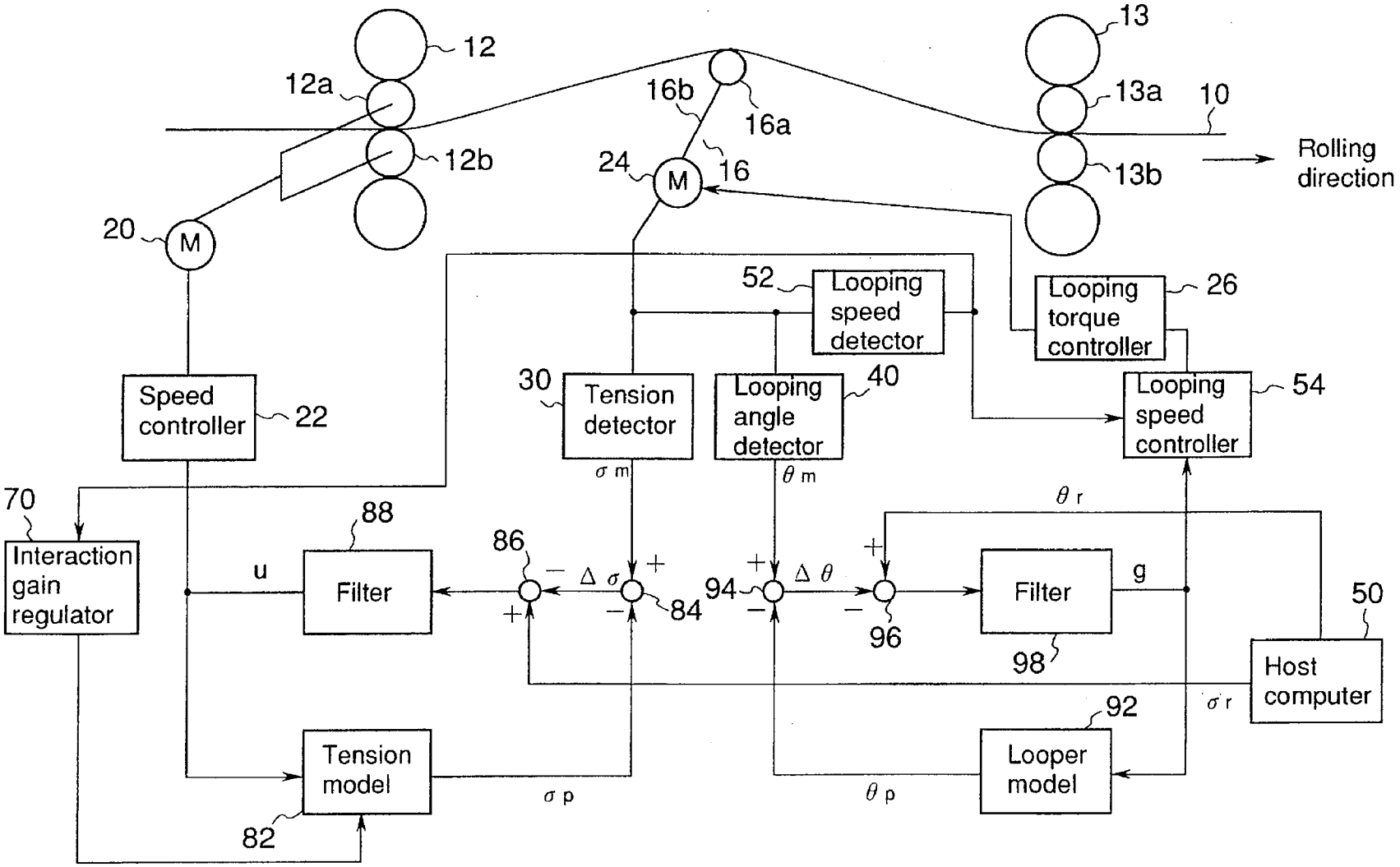
FIG. 37 is a block diagram of an interstand tension controller in a seventeenth embodiment according to the ninth aspect of the present invention.

The interstand tension controller in the sixteenth embodiment regulates the looping angle by controlling the looping torque by the looping torque controller 26. An interstand tension controller in a seventeenth embodiment according to the present invention shown in FIG. 37 is provided with a looping speed control loop including a looping speed detector 52 to feed back a detected looping speed to a looping speed controller 54.

The effects of the interstand tension controller in the sixteenth embodiment confirmed through simulation were substantially the same as those of the interstand tension controller in the fifth and the sixth embodiments shown in FIGS. 21 and 22.

Eighteenth Embodiment

Figure 38:
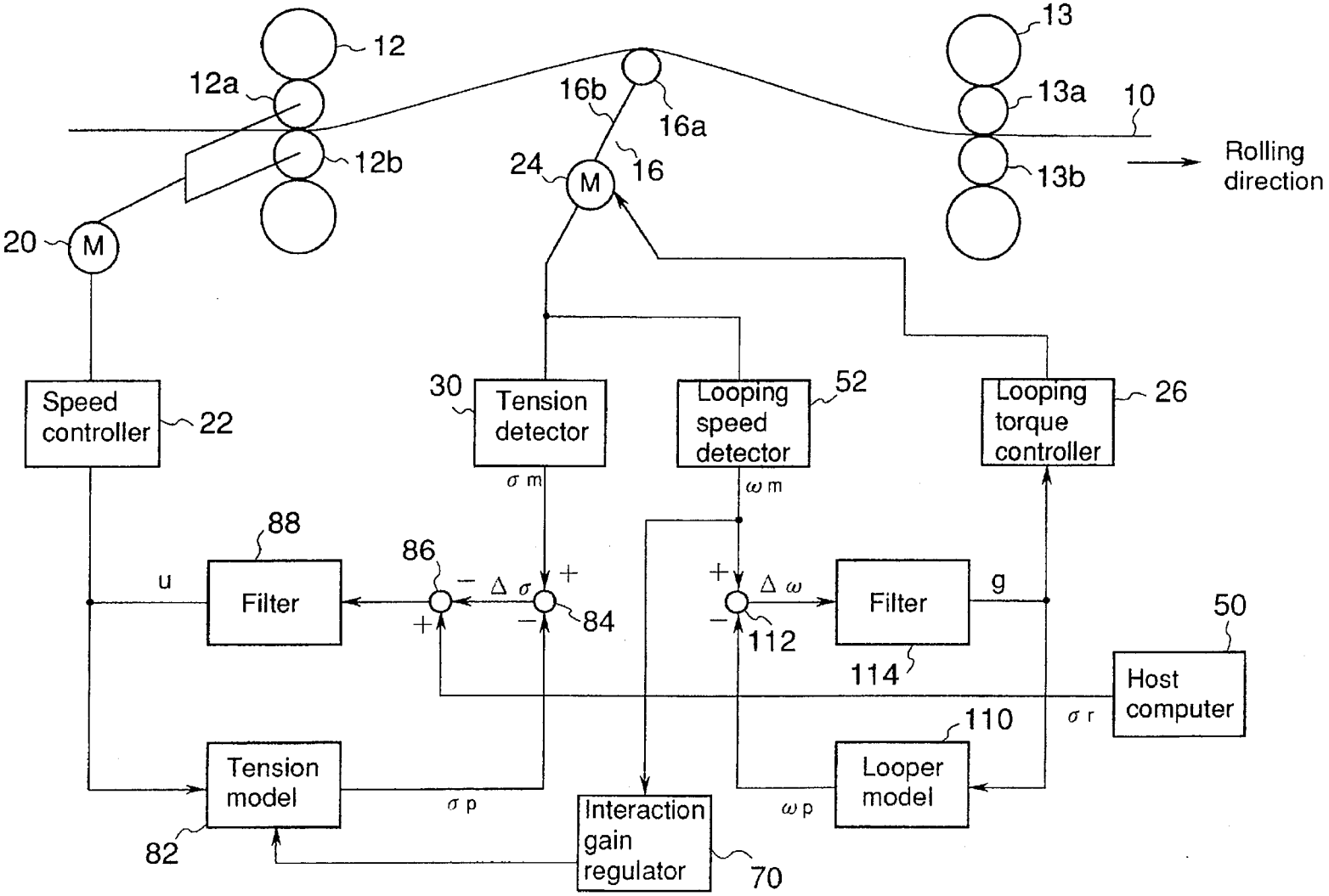
FIG. 38 is a block diagram of an interstand tension controller in an eighteenth embodiment according to the tenth aspect of the present invention.

FIG. 38 shows an interstand tension controller in a eighteenth embodiment according to the tenth aspect of the present invention. The effects of the interstand tension controller in the tenth embodiment confirmed through simulation were substantially the same as those of the interstand tension controller in the sixteenth embodiment.

Although each of the foregoing embodiments detects the interstand tension of the workpiece by the tension detector 30, the interstand tension of the workpiece may be estimated on the basis of a component of a detected looping torque due to the interstand tension of the workpiece.

The control performance of the conventional interstand tension controller that employs a control loop that regulates the interstand tension by controlling the looping torque or the looping speed, and a control loop that regulates the looping angle by controlling the rotating speed of the rolls of the rolling stand, by estimating an interaction between the two control loops as a disturbance and compensating for the interaction. However, in such a case, since the interstand tension and the looping angle are controlled indirectly through the term of interaction between tension and looping angle, the order of the controlled systems and that of the models increase and hence the interstand tension controller has a complicated configuration, which is undesirable.

The interstand tension controllers in the twelfth to the eighteenth embodiments, the tension model 82, and the looper model 92 or 110 may be substituted by a single model capable of dealing with interaction between the interstand tension and the looping angle. In such a case, since the outputs of the filters 88, 98 and 114 do not include any component to compensate for the interaction, the interstand tension controller must be provided with a precompensator, so that the two loops cannot be formed separately and the configuration is complicated. If precompensation is not performed, the control performance will be enhanced when the term of interaction is omitted from the model and the interaction is compensated for as a disturbance.

Figure 39:
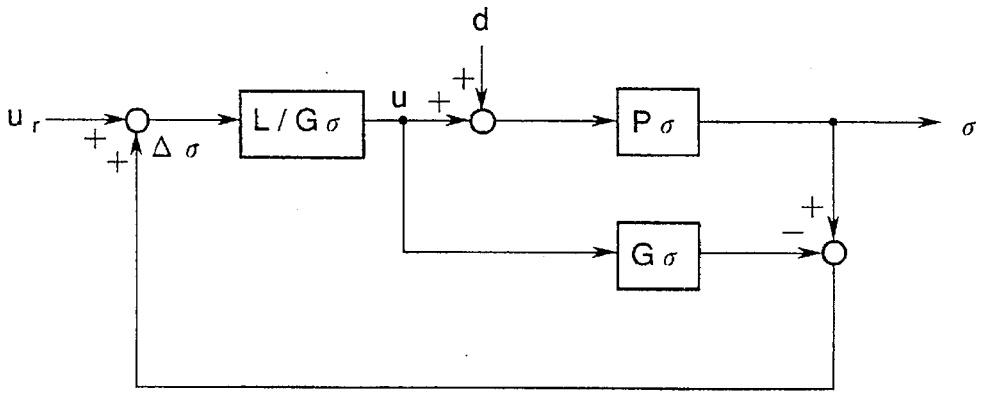
FIG. 39 is a block diagram of assistance in explaining a tension control system included in the interstand tension controllers in the twelfth to the eighteenth embodiments according to the present invention.
Figure 40:
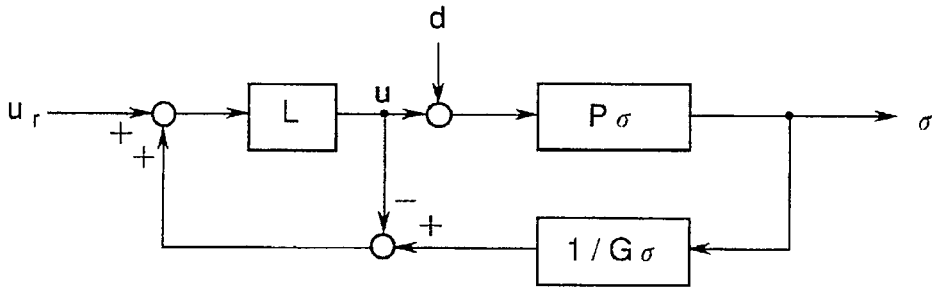
FIG. 40 is a block diagram of assistance in explaining a modification of the tension control system explained with reference to FIG. 39.
Figure 41:
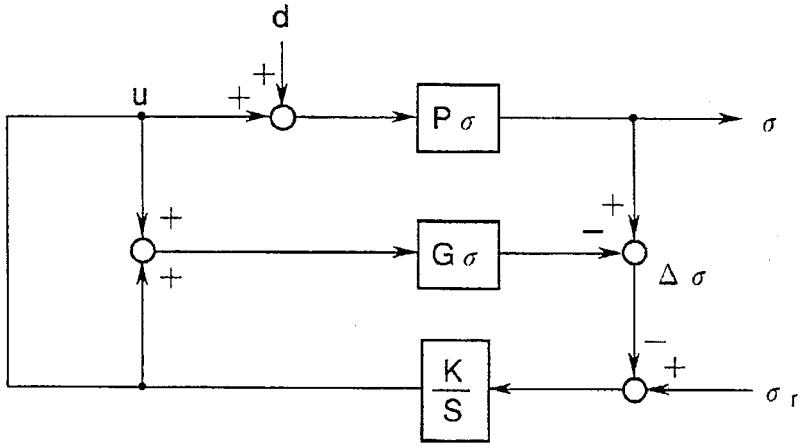
FIG. 41 is a block diagram of assistance in explaining another modification of the tension control system explained with reference to FIG. 39.

In the twelfth to the eighteenth embodiments, the difference between the output of the tension model and the measured interstand tension, and the difference between the output of the looper model and the measured looping angle are passed through the filters to obtain signals for compensating for the disturbance. The filter of the tension model employs the inverse model $1/G\sigma$ as expressed by expression (11); that is, the difference between the plant model $P\sigma$ and the model $G\sigma$ is applied to the inverse model $1/G\sigma$ as shown in FIG. 39. The output of the plant model $P\sigma$ may be applied to the inverse model $1/G\sigma$ as shown in FIG. 40. It is also possible to apply a feedback signal produced by integrating the difference between the output of the plant $P\sigma$ and that of the model $G\sigma$ and multiplying the integral by a gain K, and to use the feedback signal to the model $G\sigma$ as shown in FIG. 41. The configurations shown in FIGS. 39 to 41 may optionally be modified, provided that the modified configurations are equivalent to those shown in FIGS. 39 to 41.

The present invention is not limited in its application to the interstand tension controller for the hot rolling mill.

It should be apparent to those skilled in the art that the embodiments described herein are merely illustrative and represent the applications of the principles of the present invention, and numerous, varied arrangements other than those described herein can be readily devised by those skilled in the art without departing from the scope and spirit of the invention.

What is claimed is:

1. An interstand tension controller for use in combination with a continuous rolling mill having a plurality of rolling stands and provided with a looper between adjacent rolling stands, said interstand tension controller comprising:

a first feedback loop that measures or estimates an interstand tension of a workpiece, calculates a rotating speed command specifying a desired rotating speed for rotating rolls of a rolling stand on the basis of a difference between a desired interstand tension, and the measured or estimated working interstand tension, and corrects the rotating speed command;

a second feedback loop that measures a looping angle, calculates a looping torque command or a looping speed command on the basis of a difference between the measured looping angle and a desired looping angle, and corrects the looping torque command or the looping speed command;

a first disturbance compensator that estimates a disturbance acting on the first feedback loop on the basis of a difference between an estimated tension obtained by applying at least the sum of the rotating speed command calculated by the first feedback loop and a correction calculated by the first disturbance compensator to a model that receives at least the rotating speed command for the rotating rolls of the rolling stand and provides an interstand tension of the workpiece, and a measured or estimated working tension, and calculates a rotating speed correction to offset the estimated disturbance acting on the first feedback loop; and a second disturbance compensator that estimates a disturbance acting on the second feedback loop on the basis of a difference between an estimated looper control variable obtained by applying the sum of the looping torque command or the looping speed command calculated by the second feedback loop and a correction calculated by the second disturbance compensator to a model that receives the looping torque command or the looping speed command and provides a looper control variable, and a measured looper control variable, and calculates a looping torque correction or a looping speed correction to offset the estimated disturbance acting on the second feedback loop;

whereby the rotating speed of the rotating rolls is controlled on the basis of a value obtained by adding up the rotating speed command provided by the first feedback loop and the rotating speed correction calculated by the first disturbance compensator; and the looping torque or the looping speed is controlled on the basis of a value obtained by adding up the looping torque command or the looping speed command provided by the second feedback loop, and the looping torque correction or the looping speed correction calculated by the second disturbance compensator.

2. An interstand tension controller according to claim 1, wherein the second disturbance compensator includes a model that provides a looping angle as the looper control variable, and a disturbance acting on the second feedback loop is estimated on the basis of a difference between an estimated looping angle provided by the model and a measured looping angle.

3. An interstand tension controller according to claim 1, wherein the second disturbance compensator includes a model that provides a looping speed as a looper control variable, and a disturbance acting on the second feedback loop is estimated on the basis of a difference between an estimated looping speed and a measured looping speed.

4. An interstand tension controller according to claim 1, wherein the first disturbance compensator includes a model that receives the rotating speed command specifying a desired rotating speed for the rotating rolls of said rolling stand and the looping speed, and the estimated tension is determined on the basis of the looping speed and the sum of the rotating speed command calculated by the first feedback loop and the correction calculated by the first disturbance compensator.

5. An interstand tension controller for use in combination with a continuous rolling mill having a plurality of rolling stands and provided with a looper between adjacent rolling stands, said interstand tension controller comprising:

a first feedback loop that measures or estimates an interstand tension of a workpiece, calculates a rotating speed command specifying a desired rotating speed for rotating rolls of a rolling stand on the basis of a difference between a desired interstand tension, and a measured or estimated working interstand tension, and corrects the rotating speed command;

a second feedback loop that measures a looping angle, calculates a looping torque command or a looping speed command on the basis of a difference between a measured looping angle and a desired looping angle, and corrects the looping torque command or the looping speed command;

a first disturbance compensator that estimates a disturbance acting on the first feedback loop on the basis of a difference between an estimated tension obtained by applying the sum of the rotating speed command calculated by the first feedback loop and a correction calculated by the first disturbance compensator to a model that receives the rotating speed command for the rotating rolls of said rolling stand and provides an interstand tension of the workpiece, and a measured or estimated working tension, and calculates a rotating speed correction to offset the estimated disturbance acting on the first feedback loop; and a second disturbance compensator that estimates a disturbance acting on the second feedback loop on the basis of a difference between an estimated looping angle obtained by applying the sum of the looping torque command or the looping speed command calculated by the second feedback loop and a correction calculated by the second disturbance compensator to a model that receives the looping torque command or the looping speed command and provides a looping angle, and the measured looping angle, and calculates a looping torque correction or a looping speed correction to offset the estimated disturbance acting on the second feedback loop;

whereby the rotating speed of the rotating rolls is controlled on the basis of a value obtained by adding up the rotating speed command provided by the first feedback loop and the rotating speed correction calculated by the first disturbance compensator; and the looping torque or looping speed is controlled on the basis of a value obtained by adding up the looping torque command or the looping speed command provided by the second feedback loop, and the looping torque correction or the looping speed correction calculated by the second disturbance compensator.

6. An interstand tension controller for use in combination with a continuous rolling mill having a plurality of rolling stands and provided with a looper between adjacent rolling stands, said interstand tension controller comprising:

a first feedback loop that measures or estimates an interstand tension of a workpiece, calculates a rotating speed command for rotating rolls of a rolling stand on the basis of a difference between a desired interstand tension, and a measured or estimated working interstand tension, and corrects the rotating speed;

a second feedback loop that measures a looping angle, calculates a looping torque command or a looping speed command on the basis of a difference between a desired looping angle and the measured looping angle, and corrects the looping torque command or the looping speed command;

a first disturbance compensator that estimates a disturbance acting on the first feedback loop on the basis of a difference between an estimated tension obtained by applying the sum of the rotating speed command calculated by the first feedback loop and a correction calculated by the first disturbance compensator to a model that receives the rotating speed command for the rotating rolls of said rolling stand and provides an interstand tension of the workpiece, and a measured or estimated working interstand tension, and calculates a rotating speed correction to offset the estimated disturbance acting on the first feedback loop; and a second disturbance compensator that estimates a disturbance acting on the second feedback loop on the basis of a difference between an estimated looping speed obtained by applying the sum of the looping torque command or the looping speed command calculated by the second feedback loop and a correction calculated by the second disturbance compensator to a model that receives the looping torque command or the looping speed command and provides a looping speed, and a measured looping speed, and calculates a looping torque correction or a looping speed correction to offset the estimated disturbance acting on the second feedback loop;

whereby the rotating speed of the rotating rolls is controlled on the basis of a value obtained by adding up the rotating speed command provided by the first feedback loop and the rotating speed correction calculated by the first disturbance compensator; and the looping torque or looping speed is controlled on the basis of a value obtained by adding up the looping torque command or the looping speed command provided by the second feedback loop and the looping torque correction or the looping speed correction calculated by the second disturbance compensator.

7. An interstand tension controller for use in combination with a continuous rolling mill having a plurality of rolling stands and provided with a looper between adjacent rolling stands, said interstand tension controller comprising:

a first feedback loop that measures or estimates an interstand tension of a workpiece, calculates a rotating speed command for rotating rolls of a rolling stand on the basis if a difference between a desired interstand tension and the measured or estimated working interstand tension, and corrects the rotating speed;

a second feedback loop that measures a looping angle, calculates a looping torque command or a looping speed command on the basis of a difference between a desired looping angle and the measured looping angle, and corrects the looping torque command or the looping speed command;

a first disturbance compensator that estimates a disturbance acting on the first feedback loop on the basis of difference between an estimated tension obtained by applying the sum of the rotating speed command calculated by the first feedback loop and a correction calculated by the first disturbance compensator and a looping speed to a model that receives the rotating speed command and the looping speed and provides the interstand tension of the workpiece, and the measured or estimated working interstand tension, and calculates a rotating speed correction to offset the estimated disturbance acting on the first feedback loop; and a second disturbance compensator that estimates a disturbance acting on the second feedback loop on the basis of a difference between an estimated looping angle obtained by applying the sum of the looping torque command or the looping speed command calculated by the second feedback loop and a correction calculated by the second disturbance compensator to a model that receives the looping torque command or the looping speed command, and provides a looping angle, and a measured looping angle, and calculates a looping torque correction or a looping speed correction to offset the estimated disturbance acting on the second feedback loop;

whereby the rotating speed of the rotating rolls is controlled on the basis of a value obtained by adding up the rotating speed command provided by the first feedback loop and the rotating speed correction provided by the first disturbance compensator, the looping torque or looping speed is controlled on the basis of a value obtained by adding up the looping torque command or the looping speed command provided by the second feedback loop, and the looping torque correction or the looping speed correction calculated by the second disturbance compensator.

8. An interstand tension controller for use in combination with a continuous rolling mill having a plurality of rolling stands and provided with a looper between adjacent rolling stands, said interstand tension controller comprising:

a first feedback loop that measures or estimates an interstand tension of a workpiece, calculates a rotating speed command for rotating rolls of a rolling stand on the basis of a difference between a desired interstand tension, and a measured or estimated working interstand tension, and corrects the rotating speed;

a second feedback loop that measures a looping angle, calculates a looping torque command or a looping speed command on the basis of a difference between a desired looping angle and the measured looping angle, and corrects the looping torque command or the looping speed command;

a first disturbance compensator that estimates a disturbance acting on the first feedback loop on the basis of a difference between an estimated interstand tension obtained by applying the sum of the rotating speed command calculated by the first feedback loop and a correction calculated by the first disturbance compensator and a looping speed to a model that receives the rotating speed command for the rotating rolls of said rolling stand and the looping speed, and provides the interstand tension of the workpiece, and the measured or estimated working interstand tension, and calculates a rotating speed correction to offset the estimated disturbance acting on the first feedback loop; and a second disturbance compensator that estimates a disturbance acting on the second feedback loop on the basis of a difference between an estimated looping speed obtained by applying the sum of the looping torque command or the looping speed command calculated by the second feedback loop and a correction calculated by the second disturbance compensator to a model that receives the looping torque command or the looping speed command and provides a looping speed, and a measured looping speed, and calculates a looping torque correction or a looping speed correction to offset the estimated disturbance acting on the second feedback loop;

whereby the rotating speed of the rotating rolls of said rolling stand is controlled on the basis of a value obtained by adding up the rotating speed command provided by the first feedback loop and the rotating speed correction provided by the first disturbance compensator, and the looping torque or looping speed is controlled on the basis of a value obtained by adding up the looping torque command or the looping speed command provided by the second feedback loop and the looping torque correction or the looping speed correction provided by the second disturbance compensator.

9. An interstand tension controller for use in combination with a continuous rolling mill having a plurality of rolling stands and provided with a looper between adjacent rolling stands, said interstand tension controller comprising:

a feedback loop that calculates a rotating speed command for rotating rolls of a rolling stand, and a looping torque command or a looping speed command on the basis of a measured or estimated tension of a workpiece between the rolling stands, the deviation of the measured or estimated tension from a desired tension, a measured looping angle, the deviation of the measured looping angle from a desired looping angle, a measured rotating speed of the rotating rolls of said rolling stand and a measured looping speed, and corrects the rotating speed of the rotating rolls and the looping torque or the looping speed;

a first disturbance compensator that estimates a disturbance acting on the feedback loop on the basis of a difference between an estimated tension obtained by applying the measured looping speed and the sum of the rotating speed command for the rolls of the rolling stand calculated by the feedback loop and a correction calculated by the first disturbance compensator, to a model that receives the rotating speed command and provides the tension of the workpiece between the rolling stands, and the measured or estimated tension, and calculates a rotating speed correction to offset the estimated disturbance acting on first feedback loop; and a second disturbance compensator that estimates a disturbance acting on the feedback loop on the basis of a difference between an estimated looper control variable obtained by applying the measured or estimated tension and the sum of the looping torque command or the looping speed command calculated by the feedback loop and a correction calculated by the second disturbance compensator to a model that receives the looping torque command or the looping speed command and provides a looper control variable, and the measured looper control variable, and calculates a looping torque correction or a looping speed correction to offset the estimated disturbance acting on the feedback loop;

whereby the rotating speed of the rotating rolls of said rolling stand is controlled on the basis of the sum of the rotating speed command calculated by the feedback loop and the rotating speed correction calculated by the first disturbance compensator, and the looping torque or looping speed is controlled on the basis of the sum of the looping torque command or the looping speed command calculated by the feedback loop and the looping torque correction or the looping speed correction calculated by the second disturbance compensator.

10. An interstand tension controller according to claim 9, wherein the second disturbance compensator includes a model that provides a looping angle as the looper control variable, and a disturbance acting on the second feedback loop is estimated on the basis of a difference between an estimated looping angle provided by the model and a measured looping angle.

11. An interstand tension controller according to claim 9, wherein the second disturbance compensator includes a model that provides a looping speed as a looper control variable and, a disturbance acting on the second feedback loop is estimated on the basis of a difference between an estimated looping speed and a measured looping speed.

12. An interstand tension controller for use in combination with a continuous rolling mill having a plurality of rolling stands and provided with a looper between adjacent rolling stands, said interstand tension controller comprising:

a feedback loop that calculates a rotating speed command for rotating rolls of a rolling stand, and a looping torque command or a looping speed command on the basis of a measured or estimated tension of a workpiece between the rolling stands, the deviation of the measured or estimated tension from a desired tension, a measured looping angle, the deviation of the measured looping angle from a desired looping angle, a measured rotating speed of the rotating rolls of said rolling stand and a measured looping speed, and corrects the rotating speed of the rotating rolls and the looping torque or the looping speed;

a first disturbance compensator that estimates a disturbance acting on the feedback loop on the basis of a difference between an estimated tension obtained by applying the measured looping speed and the sum of the rotating speed command for the rolls of the rolling stand calculated by the feedback loop and a correction calculated by the first disturbance compensator, to a model that receives the rotating speed command and provides the tension of the workpiece between the rolling stands, and the measured or estimated tension, and calculates a rotating speed correction to offset the estimated disturbance acting on the feedback loop; and a second disturbance compensator that estimates a disturbance acting on the feedback loop on the basis of a difference between an estimated looping angle obtained by applying the measured or estimated tension and the sum of the looping torque command or the looping speed command calculated by the feedback loop and a correction calculated by the second disturbance compensator to a model that receives the looping torque command or the looping speed command and provides a looping angle, and calculates a looping torque correction or a looping speed correction to offset the estimated disturbance acting on the feedback loop;

whereby the rotating speed of the rotating rolls of said rolling stand is controlled on the basis of the sum of the rotating speed command calculated by the feedback loop and the rotating speed correction calculated by the first disturbance compensator, and the looping torque or looping speed is controlled on the basis of the sum of the looping torque command or the looping speed command calculated by the feedback loop and the looping torque correction or the looping speed correction calculated by the second disturbance compensator.

13. An interstand tension controller for use in combination with a continuous rolling mill having a plurality of rolling stands and provided with a looper between adjacent rolling stands, said interstand tension controller comprising:

a feedback loop that calculates a rotating speed command for rotating rolls of a rolling stand, and a looping torque command or a looping speed command on the basis of a measured or estimated tension of a workpiece between the rolling stands, the deviation of the measured or estimated tension from a desired tension, a measured looping angle, the deviation of the measured looping angle from a desired looping angle, a measured rotating speed of the rotating rolls of said rolling stand and a measured looping speed, and corrects the rotating speed of the rotating rolls and the looping torque or the looping speed;

a first disturbance compensator that estimates a disturbance acting on the feedback loop on the basis of a difference between an estimated tension obtained by applying the measured looping speed and the sum of the rotating speed command calculated by the feedback loop and a correction calculated by the first disturbance compensator to a model that receives the rotating speed command and provides the tension of the workpiece between the rolling stands, and the measured or estimated tension, and calculates a rotating speed correction to offset the estimated disturbance acting on the feedback loop; and a second disturbance compensator that estimates a disturbance acting on the feedback loop on the basis of a difference between an estimated looping speed obtained by applying the measured or estimated tension and the sum of the looping torque command or the looping speed command calculated by the feedback loop and a correction calculated by the second disturbance compensator to a model that receives the looping torque command or the looping speed command and provides a looping speed, and the measured looping speed, and calculates a looping torque correction or a looping speed correction to offset the estimated disturbance acting on the feedback loop;

whereby the rotating speed of the rotating rolls of said rolling stand is controlled on the basis of the sum of the rotating speed command calculated by the feedback loop and the rotating speed correction calculated by the first disturbance compensator, and the looping torque or looping speed is controlled on the basis of the sum of the looping torque command or the looping speed command calculated by the feedback loop and the looping torque correction or the looping speed correction calculated by the second disturbance compensator.

14. A method of regulating an interstand tension of a workpiece being rolled on a continuous rolling mill having a plurality of rolling stands and provided with a looper between adjacent rolling stands at a desired interstand tension by controlling the rotating speed of rotating rolls of a rolling stand and of regulating a looping angle at a desired looping angle by controlling a looping torque or a looping speed of the looper, said method comprising the steps of estimating a disturbance acting on a first controlled system, in which the rotating speed of the rotating rolls is a manipulated variable and the interstand tension of the workpiece is a controlled variable, on the basis of a difference between an estimated interstand tension obtained by applying a rotating speed command for the rotating rolls of said rolling stand to a first model that receives at least the rotating speed command and provides the interstand tension of the workpiece, and a measured or estimated working interstand tension;

calculating a rotating speed command to offset the estimated disturbance acting on the first controlled system;

regulating the rotating speed according to the calculated rotating speed command;

estimating a disturbance acting on a second controlled system, in which the looping torque or the looping speed of the looper is a manipulated variable and the looping angle of the looper is a controlled variable, on the basis of a difference between an estimated looper control variable obtained by applying a looping torque command or a looping speed command to a second model that receives the looping torque command or the looping speed command, and provides a looper control variable, and a measured looping angle;

calculating a looping torque command or a looping speed command to offset the estimated disturbance acting on the second controlled system; and regulating the looping torque or the looping speed according to the calculated looping torque command or the calculated looping speed command.

15. A method according to claim 14, wherein the looper control variable provided by the second model is a looping angle, and the disturbance acting on the second controlled system is estimated on the basis of a difference between an estimated looping angle provided by the second model and a measured looping angle.

16. A method according to claim 14, wherein the looper control variable provided by the second model is a looping speed, and the disturbance acting on the second controlled system is estimated on the basis of a difference between an estimated looping speed provided by the second model and a measured looping speed.

17. A method according to claim 14, wherein the estimated interstand tension is determined on the basis of the rotating speed command and the looping speed.

18. A method of regulating an interstand tension of a workpiece being rolled on a continuous rolling mill having a plurality of rolling stands and provided with a looper between adjacent rolling stands at a desired interstand tension by controlling the rotating speed of rotating rolls of a rolling stand and of regulating a looping angle at a desired looping angle by controlling a looping torque or a looping speed of the looper, said method comprising the steps of:

estimating a disturbance acting on a first controlled system, in which the rotating speed of the rotating rolls is a manipulated variable and the interstand tension of the workpiece is a controlled variable, on the basis of a difference between an estimated interstand tension obtained by applying a rotating speed command for the rotating rolls of said rolling stand to a first model that receives the rotating speed command and provides the interstand tension of the workpiece, and a measured or estimated working interstand tension;

calculating a rotating speed command to offset the estimated disturbance acting on the first controlled system;

regulating the rotating speed according to the calculated rotating speed command;

estimating a disturbance acting on a second controlled system, in which the looping torque or the looping speed of the looper is a manipulated variable and the looping angle of the looper is a controlled variable, on the basis of a difference between an estimated looping angle obtained by applying a looping torque command or a looping speed command to a second model that receives the looping torque command or the looping speed command, and provides a looping angle, and a measured looping angle;

calculating a looping torque command or a looping speed command to offset the estimated disturbance acting on the second controlled system; and regulating the looping torque or the looping speed according to the calculated looping torque command or the calculated looping speed command.

19. A method of regulating an interstand tension of a workpiece being rolled on a continuous rolling mill having a plurality of rolling stands and provided with a looper between adjacent rolling stands at a desired interstand tension by controlling the rotating speed of rotating rolls of a rolling stand and of regulating a looping angle at a desired looping angle by controlling a looping torque or a looping speed of the looper, said method comprising the steps of:

estimating a disturbance acting on a first controlled system, in which the rotating speed of the rotating rolls is a manipulated variable and the interstand tension of the workpiece is a controlled variable, on the basis of a difference between an estimated interstand tension obtained by applying a rotating speed command for the rotating rolls of said rolling stand to a first model that receives the rotating speed command and provides the interstand tension of the workpiece, and a measured or estimated working interstand tension;

calculating a rotating speed command to offset the estimated disturbance acting on the first controlled system;

regulating the rotating speed according to the calculated rotating speed command;

estimating a disturbance acting on a second controlled system, in which the looping torque or the looping speed of the looper is a manipulated variable and the looping angle of the looper is a controlled variable, on the basis of a difference between an estimated looping speed obtained by applying a looping torque command or a looping speed command to a second model that receives the looping torque command or the looping speed command, and provides a looping speed, and a measured looping speed;

calculating a looping torque command or a looping speed command to offset the estimated disturbance acting on the second controlled system; and regulating the looping torque or the looping speed according to the calculated looping torque command or the calculated looping speed command.

20. A method of regulating an interstand tension of a workpiece being rolled on a continuous rolling mill having a plurality of rolling stands and provided with a looper between adjacent rolling stands at a desired interstand tension by controlling the rotating speed of rotating rolls of a rolling stand and of regulating a looping angle at a desired looping angle by controlling a looping torque or a looping speed of the looper, said method comprising the steps of:

estimating a disturbance acting on a first controlled system, in which the rotating speed of the rotating rolls is a manipulated variable and the interstand tension of the workpiece is a controlled variable, on the basis of a difference between an estimated interstand tension obtained by applying a rotating speed command for the rotating rolls of said rolling stand and the looping speed to a first model that receives the rotating speed command and the looping speed and provides the interstand tension of the workpiece, and a measured or estimated working interstand tension;

calculating a rotating speed command to offset the estimated disturbance acting on the first controlled system;

regulating the rotating speed according to the calculated rotating speed command;

estimating a disturbance acting on a second controlled system, in which the looping torque or the looping speed is a manipulated variable and the looping angle is a controlled variable, on the basis of a difference between an estimated looping angle obtained by applying a looping torque command or a looping speed command to a second model that receives the looping torque command or the looping speed command, and provides a looping angle, and a measured looping angle;

calculating a looping torque command or a looping speed command to offset the estimated disturbance acting on the second controlled system; and regulating the looping torque or the looping speed according to the calculated looping torque command or the calculated looping speed command.

21. A method of regulating an interstand tension of a workpiece being rolled on a continuous rolling mill having a plurality of rolling stands and provided with a looper between adjacent rolling stands at a desired interstand tension by controlling the rotating speed of rotating rolls of a rolling stand and of regulating a looping angle at a desired looping angle by controlling a looping torque or a looping speed of the looper, said method comprising the steps of:

estimating a disturbance acting on a first controlled system, in which the rotating speed of the rotating rolls is a manipulated variable and the interstand tension of the workpiece is a controlled variable, on the basis of a difference between an estimated interstand tension obtained by applying a rotating speed command for the rotating rolls of said rolling stand and a looping speed to a first model that receives the rotating speed command and the looping speed and provides the interstand tension of the workpiece, and a measured or estimated working interstand tension;

calculating a rotating speed command to offset the estimated disturbance acting on the first controlled system;

regulating the rotating speed according to the calculated rotating speed command;

estimating a disturbance acting on a second controlled system, in which the looping torque or the looping speed is a manipulated variable and the looping angle is a controlled variable, on the basis of a difference between an estimated looping speed obtained by applying a looping torque command or a looping speed command to a second model that receives the looping torque command or the looping speed command, and provides a looping speed, and a measured looping speed;

calculating a looping torque command or a looping speed command to offset the estimated disturbance acting on the second controlled system; and regulating the looping torque or the looping speed according to the calculated looping torque command or the calculated looping speed command.

* * * * *